US006222319B1

(12) United States Patent
Yoshihara et al.

(10) Patent No.: US 6,222,319 B1
(45) Date of Patent: Apr. 24, 2001

(54) MAGNETRON APPARATUS HAVING A SEGMENTED ANODE EDGES AND MANUFACTURING METHOD

(75) Inventors: Masanori Yoshihara, Imaichi; Yasunobu Nakano, Otsu; Hiroshi Ochiai, Tochigi, all of (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/057,020

(22) Filed: Apr. 7, 1998

(30) Foreign Application Priority Data

Apr. 11, 1997 (JP) ..... 9-093480

(51) Int. Cl.[7] ..... H01J 25/50; H01J 23/02
(52) U.S. Cl. ..... 315/39.75; 445/35
(58) Field of Search ..... 315/39.75, 39.51, 315/39.69; 445/35

(56) References Cited

U.S. PATENT DOCUMENTS 2,433,339 12/1947 Brown .

FOREIGN PATENT DOCUMENTS

| | | | |
|---|---|---|---|
| 53112658 | 10/1978 | (JP) . | |
| 202042 * | 12/1982 | (JP) | 315/39.75 |
| 219838 * | 12/1984 | (JP) | 315/39.75 |
| 17836 * | 1/1985 | (JP) | 315/39.69 |
| 62-290039 | 12/1987 | (JP) . | |
| 01052365 | 2/1989 | (JP) . | |
| 72542 * | 3/1990 | (JP) | 315/39.75 |
| 5-190102 | 7/1993 | (JP) . | |
| 7-326295 | 12/1995 | (JP) . | |

* cited by examiner

*Primary Examiner*—Benny T. Lee
(74) *Attorney, Agent, or Firm*—Sheridan Ross P.C.

(57) ABSTRACT

In a magnetron apparatus and a manufacturing method of the present invention, the magnetron apparatus comprises an anode cylinder, and a plurality of plate-form anode segments radially arranged around a central axis of the anode cylinder inside the anode cylinder. The anode segments are pressed against an inner surface of the anode cylinder by a pin press-fit into the central portion of the anode cylinder, and a far-end-side end surface each of the anode segments is secured to the inner surface. A concave is provided in the central portion of an inner end surface where the anode segments come into contact with the pin.

17 Claims, 19 Drawing Sheets

MAGNETRON APPARATUS HAVING A SEGMENTED ANODE EDGES AND MANUFACTURING METHOD

BACKGROUND OF THE INVENTION

The present invention relates to a magnetron apparatus for use in microwave ovens and the like, and a manufacturing method for the same.

The magnetron apparatus is a microwave oscillating tube which operates at a fundamental frequency of, for example, 2,450 MHz, and is used as a high frequency source in electric apparatuses using microwaves such as microwave heaters and microwave discharge lamps. A typical configuration of the magnetron apparatus is such that a cathode and an anode are disposed coaxially cylindrically. More specifically, the magnetron apparatus comprises a coiled cathode, an anode cylinder disposed with the cathode as the central axis, and plural anode segments radially arranged around the central axis in a space inside the anode cylinder for defining a resonant cavity. The magnetron apparatus further comprises a pair of magnetic pole pieces disposed at upper and lower open ends of the anode cylinder and magnetically associated with an annular permanent magnet, plural strap rings for electrically interconnecting the anode segments, and an antenna with one end connected to one of the anode segments for discharging microwaves.

In the above-mentioned magnetron apparatus, after the anode cylinder, the anode segments, the antenna, the strap rings and the magnetic pole pieces are integrally assembled as an anode assembly, the cathode is disposed in the central portion of the anode assembly. In the magnetron apparatus, as well known, the precision with which the components are assembled greatly influences the performance of the apparatus, and the arrangement of the plural anode segments for defining a desired resonant cavity inside the anode cylinder are particularly important. Therefore, it is a technical problem of the magnetron apparatus to coaxially and radially secure the plural anode segments with high precision so as to be equally spaced on the inner surface of the anode cylinder with a predetermined distance from the cathode.

As a conventional manufacturing method for the magnetron apparatus, a brazing and soldering method is known in which the anode segments are pressed against the inner surface of the anode cylinder by use of a temporary assembling pin and all the anode segments are secured to the inner surface at once with a brazing filler metal as disclosed in, for example, examined and published Japanese patent application TOKKO Sho 57-18823.

Hereinafter, the conventional magnetron apparatus and the manufacturing method will be described with reference to FIG. 16 and FIG. 17.

FIG. 16 is a partially cutaway perspective view showing a configuration of a principal part of an anode assembly in a conventional magnetron apparatus before a brazing filler metal is melted. FIG. 17 is a cross sectional view showing the configuration of the principal part of the anode assembly in the conventional magnetron apparatus after the brazing filler metal is melted.

As shown in FIG. 16 and FIG. 17, plural anode segments 52 (52*a*, 52*b*, 52*c*, 52*d*, as depicted in FIG. 16) are coaxially radially arranged inside an anode cylinder 51. Specifically, for example, ten anode segments 52 are equally spaced inside the anode cylinder 51. Each of the anode segments 52 is formed into a substantial rectangular shape having a longitudinal size of 9.5 mm and a lateral size of 13 mm, for example. In each of the anode segments 52, one end surface on the shorter side is secured to the inner surface of the anode cylinder 51. These anode segments 52 are pressed against the inner surface of the anode cylinder 51 by a jig pin 40, which is a temporarily used assembling pin, shown by the dash and dotted line of the figure, and the above-mentioned one end surface is secured to the inner surface of the anode cylinder 51 by melting a wire-form brazing filler metal 56 (FIG. 16).

When a non-illustrated coiled cathode is disposed along the central axis of the anode cylinder 51, each end surfaces of the anode segments 52 on the central side in the direction of the arrangement, i.e. an end surface each of the anode segments 52 opposed to the above-mentioned one end surface (hereinafter, the end surface on the central side will be referred to as an "inner end surface") is situated with a predetermined distance from the cathode, so as to define a desired resonant cavity inside the anode cylinder 51.

At opposite end surfaces (i.e., upper surface and lower surface) on the longer side of each of the anode segments 52, strap ring grooves 53*a* and 53*b* are provided for brazing two pairs of strap rings 54 (54*a* and 54*b*) and 55 (55*a* and 55*b*). At the upper end surface of each of the anode segments 52 where the strap ring groove 53*a* is provided, a terminal groove 53*c* is provided for connecting one end of a non-illustrated antenna.

The strap rings 54*b* and 55*a* are brazed to every two anode segments 52*a*, 52*c*, - - - , and the strap rings 54*a* and 55*b* are brazed to the remaining anode segments 52*b*, 52*d*, - - - . A plating layer (not shown) of the brazing filler metal 56 is formed on the surface of each of the strap rings 54 and 55, and when the brazing filler metal 56 is melted to secure the one end surfaces of the anode segments 52 to the inner surface of the anode cylinder 51, the plating layer is also melted, so that the strap rings 54 and 55 are secured to the corresponding anode segments 52.

The above-mentioned anode cylinder 51, anode segments 52, strap rings 54 and 55, and antenna (not shown) are made of, for example, oxygen free copper. The jig pin 40 is made of a metal member containing silicon nitride ($Si_3N_4$), and the surface of a cylindrical portion which comes into contact with the inner end surface of each of the anode segments 52 is formed so as to be as smooth as the mirror finished surface. The brazing filler metal 56 is made of an alloy of silver and copper, and the strap rings 54 and 55 and the antenna (not shown) are made of copper having a silver plating layer provided on the surface thereof.

In such a conventional manufacturing method for the magnetron apparatus, first, the plural anode segments 52 and the strap rings 54 and 55 are placed in the respective positions inside the anode cylinder 51 by use of a non-illustrated temporary assembling jig. Then, the jig pin 40 is moved along the central axis of the anode cylinder 51 and press-fit from below into the central portion in the direction of the arrangement of the anode segments 52 (the central portion of the anode cylinder 51) as shown by the arrow Y of FIG. 16. So that the jig pin 40 contacts with the inner end surfaces of the anode segments 52. Thereby, the anode assembly is maintained in a preassembled condition where the one end surface each of the anode segments 52 are pressed against the inner surface of the anode cylinder 51 by the jig pin 40. Hereafter, only the temporary assembling jig is detached, and the brazing filler metal 56 is placed on the end surfaces on the longer side of the anode segments 52 so as to be in contact with the inner surface of the anode cylinder 51 as shown in FIG. 16. After one of the magnetic pole pieces (not shown) is attached to an upper open end of the anode cylinder 51, one end of the antenna (not shown) is attached to one of the anode segments 52. Then, the anode assembly in the preassembled condition is heated to a predetermined temperature (for example, 800 to 900° C.) in a non-illustrated furnace. Thereby, the brazing filler metal 56 is melted and flows into a clearance between the inner surface of the anode cylinder 51 and the one end surface each of the anode segments 52 caused by expansion. At this time, the plating layers on the strap rings 54 and 55 and the antenna (not shown) are also melted. Hereafter, by taking the anode assembly out of the furnace while maintaining the preassembled condition, and cooling it, the inner surface of the anode cylinder 51 and the one end surface each of the anode segments 52, the strap ring grooves 53*a* and 53*b* and the corresponding strap rings 54 and 55, and the one of the anode segment 52 and the antenna (not shown) are secured.

Consequently, after the jig pin 40 is downwardly pulled out, the other of the magnetic pole pieces (not shown) is attached to a lower open end of the anode cylinder 51, and thereby the assembly of the anode assembly is finished.

In the conventional magnetron apparatus and the manufacturing method as described above, when the jig pin 40 is press-fit or taken out by moving it in the direction of the central axis, the jig pin 40 comes into contact with and rubs against the inner end surface of each of the anode segments 52 over the entire surface in the direction of the central axis. That is, in the conventional magnetron apparatus and the manufacturing method, the contact surface of the jig pin 40 and each the anode segments 52 equal the length of the inner end surface in the direction of the central axis, and the length of the contact surface (shown at A in FIG. 16) is long. For this reason, in the conventional magnetron apparatus and the manufacturing method, during the while the jig pin 40 is being press-fit or being taken out, contact pressure exerted on the anode segments 52 through the contact surfaces increases, so that the anode segments 52 are apt to be deformed. When such deformation is caused on the anode segments 52, the molten brazing filler metal 56 does not deposit onto the entire surface of the one end surface each of the anode segments 52 but the anode segments 52 come off due to insufficient brazing. Further, the deformation of the anode segments 52 changes the configuration of the strap ring grooves 53*a* and 53*b*, so that deformation of the strap rings 54 and 55 are caused and the strap rings 54 and 55 come off because the strap rings 54 and 55 are not secured to the strap ring grooves 53*a* and 53*b*.

When the components such as the plural anode segments 52 are mass-produced, it is difficult to form these components so as to have uniform outer dimensions and it is impossible to completely prevent the outer dimensions from varying. For this reason, in the conventional magnetron apparatus and the manufacturing method, there are occasions when the anode and the cathode are short-circuited because of the variation in outer dimension. Specifically, in the case that the outer dimensions of the anode segments 52 are greater than predetermined outer dimensions and the outer dimensions of the inner surface of the anode cylinder 51 are smaller than predetermined outer dimensions, when the jig pin 40 is press-fit from below, the inner end surface each of the anode segments 52 is extended in the movement direction of the jig pin 40 by stress caused by the press fitting of the jig pin 40, so that copper foil burrs 57 as illustrated in FIG. 18 are caused at the upper end of the inner end surface. As a result, when the cathode is placed along the central axis of the anode assembly (anode cylinder 51), it often happens that the burrs 57 come into contact with the cathode and the contact causes a short circuit. Further, in the case that the anode cylinder 51 or the anode segments 52 are formed to have outer dimensions which are different from predetermined outer dimensions as mentioned above, greater power is necessary when the jig pin 40 is press-fit or taken out, thus resulting in dents and scratches on the jig pin 40 that require the jig pin 40 to be replaced.

Further, in each of the anode segments 52, as has been explained in the above, the strap ring groove 53*a* and the terminal groove 53*c* are provided at one of the end surface on the longer side, and the strap ring groove 53*b* is provided at the other end surface. For this reason, in the conventional magnetron apparatus and the manufacturing method, when the jig pin 40 is press-fit so as to be in contact with the inner end surface each of the anode segments 52, the pressing force which the anode segments 52 receive from the jig pin 40 and the anode cylinder 51 is not uniform in the direction of the central axis. Specifically, when each anode segment 52 is divided into three areas, for example, an upper area Va, a central area Vb and a lower area Vc in the direction of the central axis as shown in FIG. 17, the central area Vb does not include the grooves 53*a*, 53*b* and 53*c*. Therefore, the pressure exerted on the central area Vb is greater than that exerted on the upper and lower areas Va and Vc. When the anode assembly in the preassembled condition is heated, since the anode segments 52 expand and the molten brazing filler metal 56 flows into the clearance between the anode cylinder 51 and the anode segments 52, the pressing force applied on the upper and lower areas Va and Vc by the jig pin 40 is smaller than the pressing force which the central area Vb receives therefrom.

Thus, when the pressing force exerted on the anode segments 52 is not uniform in the direction of the central axis, because of the above-mentioned reasons combined with the fact that the surface of the jig pin 40 is as smooth as the mirror finished surface, the anode segments 52 slide over the inner surface and are secured to the inner surface of the anode cylinder 51 with the one end surfaces of the anode segments 52 being inclined from the direction of the central axis. Consequently, in the conventional magnetron apparatus and the manufacturing method, the distance between two adjoining anode segments 52, i.e. the pitch varies as shown at P1, P2 and P3 in FIG. 19, so that the plural anode segments 52 are not equally spaced inside the anode cylinder 51.

As has been explained above, in the conventional magnetron apparatus and the manufacturing method, deformation of the anode segments 52 and the strap rings 54 and 55 and coming-off of brazed parts due to insufficient brazing are apt to occur, and the burrs 57 and the variation in pitch of the plural anode segments 52 result therefrom. Therefore, in the conventional magnetron apparatus and the manufacturing method, it has been impossible to define the desired resonant cavity inside the anode assembly 51, so that it is impossible to oscillate microwaves of the fundamental frequency with stability. Further, the magnetron efficiency deteriorates and high-frequency noises are markedly generated.

Examples of a conventional magnetron apparatus intended for reducing the contact pressure between the jig pin 40 and the anode segments 52 include one disclosed in unexamined and published Japanese patent application TOKKAI Sho 64-52365. In the conventional magnetron apparatus, by forming the cylindrical portion of the jig pin 40 so as to have dimensions which are 50 to 70% of the inner end surface each of the anode segments 52, the contact pressure is reduced which is caused when the jig pin 40 is press-fit or taken out.

However, in the conventional magnetron apparatus, when the anode segments 52 are pressed against the inner surface of the anode cylinder 51, on the inner end surface each of the anode segments 52 there are produced one area which is pressed by being in contact with the cylindrical portion of the jig pin 40 and the other area which is not pressed because it does not come into contact with the cylindrical portion. Thereby, in the conventional magnetron apparatus, the pressing force which the anode segments 52 receive is unbalanced in the direction of the central axis, so that in addition to the problem that the anode segments are not equally spaced, a new problem arises that the diameter of an inscribed circle defined by the inner end surface each of the plural anode segments 52 varies in the direction of the central axis (the vertical direction). Because of these problems, the conventional magnetron apparatus is not realized and commercialized.

SUMMARY OF THE INVENTION

The object of the present invention is to provide a magnetron apparatus and a manufacturing method for the same that can solve the aforementioned problems in the conventional apparatus and can be configured with less cost and has a long life.

In order to achieve the above-mentioned object, a magnetron apparatus comprises:

an anode cylinder, and a plurality of plate-shaped anode segments radially arranged around the central axis of the anode cylinder inside the anode cylinder, and pressed against an inner surface of the anode cylinder by a pin press-fit into the central portion of the anode cylinder, so that a far-end-side end surface each of the anode segments is secured to the inner surface, wherein each of the anode segments has a concave at the central portion of an inner end surface which comes into contact with the pin.

According to this configuration, a conventionally-used existing assembly jig can be used without any modification. Further, the precision with which the magnetron apparatus is assembled can be easily improved, so that the magnetron apparatus can be operated with stability.

In the magnetron apparatus of another aspect of the present invention, a length of the concave in the direction of the central axis is 20 to 50% of a length of the inner end surface in the direction of the central axis.

According to this configuration, the deterioration of magnetron efficiency can be reduced.

In the magnetron apparatus of another aspect of the present invention, a chamfered portion is provided on at least one angular portion of the inner end surface in the direction of the central axis.

According to this configuration, a magnetron apparatus with higher assembly precision can be obtained.

A manufacturing method for a magnetron apparatus of the present invention comprises:

an anode cylinder; and a plurality of plate-form anode segments radially arranged around the central axis of the anode cylinder inside the anode cylinder, and pressed against an inner surface of the anode cylinder by a pin press-fit into the central portion of the anode cylinder, so that a far-end-side end surface each of the anode segments is secured to the inner surface, said method includes:

a step in which a concave is provided in a central portion of an inner end surface each of the anode segments, which comes into contact with the pin; and a step in which the pin is press-fit into the central portion of the anode cylinder and the far-end-side end surface is pressed against and secured to the inner surface of the anode cylinder.

According to this configuration, a conventionally-used existing assembly jig can be used as it is without any modification. Further, the assembly precision of the magnetron apparatus can be easily improved, so that the magnetron apparatus can be operated with stability.

In the manufacturing method for the magnetron apparatus of another aspect of the present invention, further comprises a step in which a length of the concave in the direction of the central axis is formed so as to be 20 to 50% of a length of the inner end surface in the direction of the central axis.

According to this configuration, the pressure exerted on the anode segments by an assembly member can be sufficiently reduced, so that a magnetron apparatus with high assembly precision can be obtained.

In the manufacturing method for the magnetron apparatus of another aspect of the present invention, further comprises a step in which a chamfered portion is provided on at least one angular portion of the inner end surface in the direction of the central axis.

According to this configuration, the insertion pressure of the assembly member exerted on the central portion of the anode cylinder can be further reduced.

DETAILED DESCRIPTION OF THE INVENTION

Hereinafter, preferred embodiments of a magnetron apparatus and that of a manufacturing method in accordance with the present invention will be described with reference to the accompanying drawings.

<<First Embodiment>>

Figure 1:
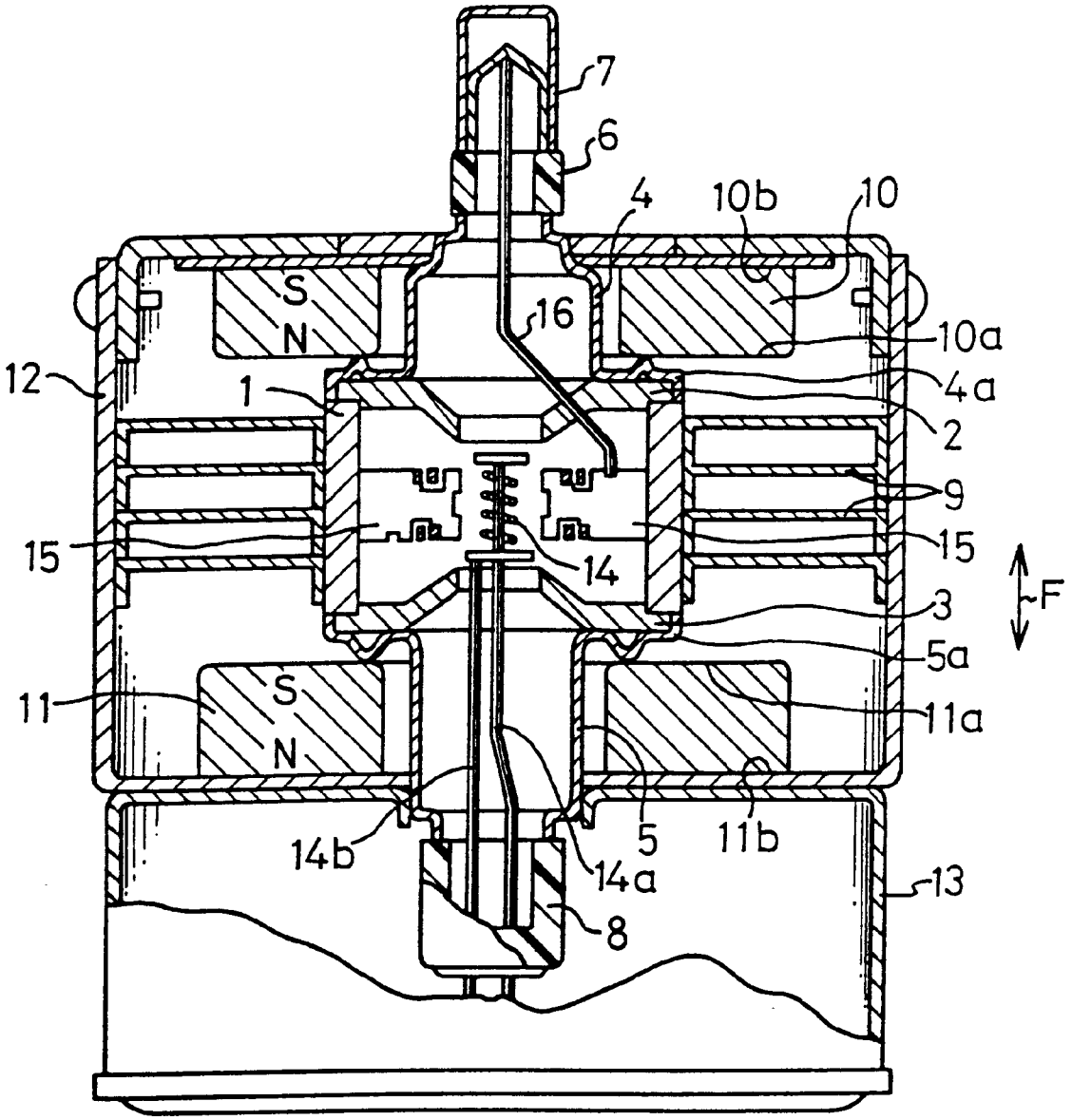
FIG. 1 is a cross sectional view showing a configuration of a magnetron apparatus of a first embodiment of the present invention.
Figure 2:
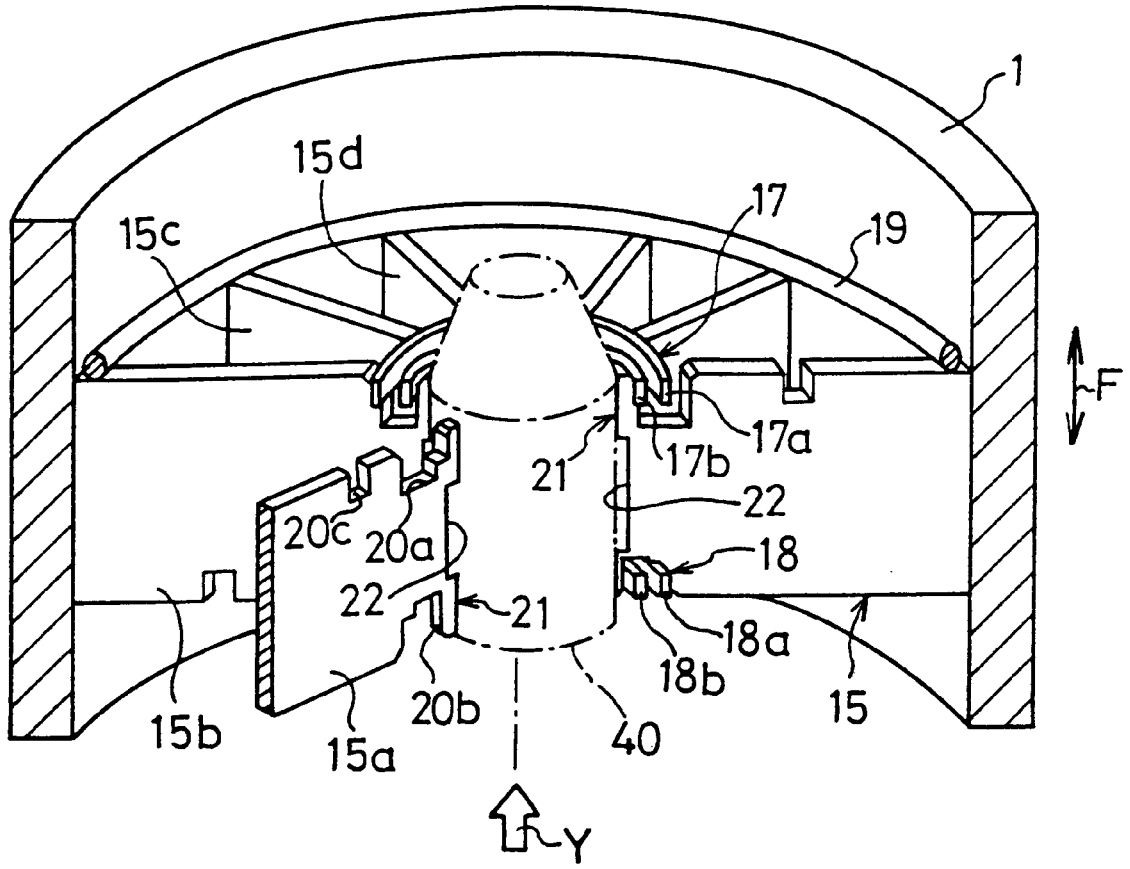
FIG. 2 is a partially cutaway perspective view showing a configuration of a principal part of an anode assembly in the magnetron apparatus shown in FIG. 1 before a brazing filler metal is melted.
Figure 3:
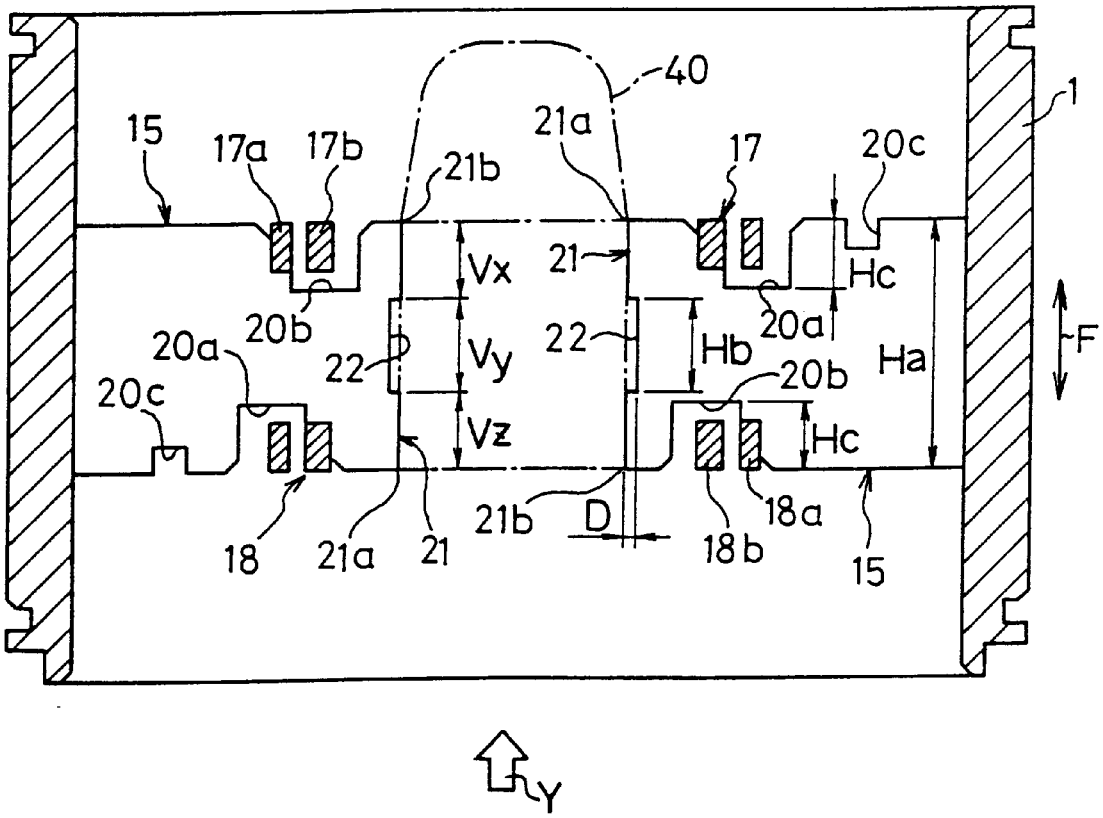
FIG. 3 is a cross sectional view showing the configuration of the principal part of the anode assembly in the magnetron apparatus shown in FIG. 1 after the brazing filler metal is melted.

FIG. 1 is a cross sectional view showing a configuration of a magnetron apparatus of a first embodiment of the present invention. FIG. 2 is a partially cutaway perspective view showing a configuration of a principal part of an anode assembly in the magnetron apparatus shown in FIG. 1 before a brazing filler metal is melted. FIG. 3 is a cross sectional view showing the configuration of the principal part of the anode assembly in the magnetron apparatus shown in FIG. 1 after the brazing filler metal is melted. It should be appreciated that common reference numerals are used within the figures herein to represent the same or similar structures within the various embodiments.

In FIG. 1, the magnetron apparatus of the present invention comprises an anode cylinder 1, first and second magnetic pole pieces 2 and 3 attached to upper and lower open ends of the anode cylinder 1, respectively, and first and second grommetted metal cylinders 4 and 5 attached to the first and second magnetic pole pieces 2 and 3, respectively. The outer end surface of the first magnetic pole piece 2 is covered with a flange 4*a* provided at one end of the first metal cylinder 4, and a rim of the flange 4*a* is secured to the upper open end of the anode cylinder 1. To the other end of the first metal cylinder 4, a microwave output terminal 7 is sealed through an insulating ring 6. Likewise, the outer end surface of the second magnetic pole piece 3 is covered with a flange 5*a* provided at one end of the second metal cylinder 5, and a rim of the flange 5*a* is secured to the lower open end of the anode cylinder 1. To the other end of the second metal cylinder 5, a cathode terminal lead stem 8 is sealed.

On the periphery of the anode cylinder 1, a plurality of fins 9 are provided in a multiplicity of stages in order to discharge heat generated inside the anode cylinder 1. On the peripheral end surface of the first magnetic pole piece 2, a first annular permanent magnet 10 is placed coaxially with on the flange 4*a*, and one magnetic pole surface 10*a* and the first magnetic pole piece 2 are magnetically associated with each other. Similarly, on the peripheral end surface of the second magnetic piece 3, a second annular permanent magnet 11 is placed coaxially with on the flange 5*a*, and one magnetic pole surface 11*a* and the second magnetic pole piece 3 are magnetically associated with each other. The other magnetic pole surfaces 10*b* and 11*b* of the first and second permanent magnets 10 and 11 are magnetically interconnected by a pot-shaped yoke 12 surrounding the fins 9. In order to prevent leakage of high-frequency noises, a metallic shield case 13 incorporating the above-mentioned stem 8 and a known LC filter circuit member (not shown) is attached to the bottom of the pot-shaped yoke 12.

Inside the anode cylinder 1, a coiled cathode 14 disposed along the central axis of the anode cylinder 1 and plural anode segments 15 coaxially and radially arranged around the cathode 14 for defining a resonant cavity are provided. The cathode 14 is connected to a pair of cathode terminals 14*a* and 14*b* inside the anode cylinder 1. The pair of cathode terminals 14*a* and 14*b* are led out of the anode cylinder 1 through the stem 8, and connected to a non-illustrated high-frequency power source. Inside the anode cylinder 1, an antenna 16 with one end connected to the microwave output terminal 7 is connected to one of the anode segments 15. Thereby, the magnetron apparatus discharges a microwave having a fundamental frequency of, for example, 2,450 MHz from the microwave output terminal 7.

Here, an anode assembly of the magnetron apparatus of this embodiment will be described in more detail with reference to FIG. 1 to FIG. 3.

In FIG. 1 to FIG. 3, the anode assembly is one of the assembly units at the time of manufacture of the magnetron apparatus, and is an integral assembly of the anode cylinder 1, the first and second magnetic pole pieces 2 and 3, the plural anode segments 15, the antenna 16 and two pairs of strap rings 17 (17*a* and 17*b*) and 18 (18*a* and 18*b*) for interconnecting the plural anode segments 15 inside the anode cylinder 1 as seen in FIGS. 2, 3. Such an anode assembly enables improvement of the assembly precision of the magnetron apparatus. The anode cylinder 1, the anode segments 15 and the strap rings 17 and 18 are made of the same metal material, for example, oxygen free copper, and secured by the brazing and soldering method using a brazing filler material made of an alloy of silver and copper. The antenna 16 is made of, for example, oxygen free copper, and the first and second magnetic pole pieces 2 and 3 are made of a magnetic material such as iron.

Inside the anode cylinder 1, the plural, for example, ten anode segments 15 (15*a*, 15*b*, 15*c*, 15*d*, as seen in FIG. 2) are equally spaced. Each of the anode segments 15 is formed into a plate shape having a longitudinal size of 9.5 mm, a lateral size of 13 mm, and a thickness size of 2 mm, for example. These anode segments 15 are pressed against the inner surface of the anode cylinder 1 by a jig pin 40, which is temporarily used assembling pin, shown by the dash and dotted line of FIGS. 2, 3, and one end surface on the shorter side is secured to the inner surface of the anode cylinder 1 by melting a wire-form brazing filler metal 19 (FIG. 2). At opposite end surfaces (i.e., upper surface and lower surface) on the longer side of each of the anode segments 15, strap ring grooves 20*a* and 20*b* are provided for brazing the two pairs of the strap rings 17 (17*a* and 17*b*) and 18 (18*a* and 18*b*). At the upper end surface of each of the anode segments 15 where the strap ring groove 20*a* is provided, a terminal groove 20*c* is provided for connecting one end of the antenna 16. The strap rings 17*b* and 18*a* are brazed to every two anode segments 15*a*, 15*c*, - - - , and the strap rings 17*a* and 18*b* are brazed to the remaining anode segments 15*b*, 15*d*, - - - . A plating layer (not shown) of the brazing filler metal 19 is formed on the surface of each of the strap rings 17 and 18, and when the brazing filler metal 19 is melted to secure the one end surface each of the anode segments 15 to the inner surface of the anode cylinder 1, the plating layer is also melted, so that the strap rings 17 and 18 are secured to the corresponding anode segments 15.

With reference to FIGS. 2 and 3, at an end surface of each of the anode segments 15 on the central side in the direction of the arrangement, i.e. an inner end surface 21 opposed to one end surface on the shorter side and in contact with the jig pin 40, a concave 22 having a rectangular opening configuration is provided in the central portion in the direction of the central axis (shown by the arrow F of FIGS. 1–3) of the anode cylinder 1. Here, the opening configuration is the configuration of the concave 22 sighted in a thickness direction each of the anode segments 15. As illustrated in FIG. 3, the concave 22 is formed by cutting the inner end surface 21 so as to have a length Hb in the direction of the central axis and a depth D in the direction of the radius of the anode cylinder 1. The length Hb of the concave 22 is selected so as to be 20 to 50% of a length Ha of the inner end surface 21 in the direction of the central axis. At the inner end surface 21, a chamfered portion may be provided in which at least one of the angular portions 21*a* and 21*b* in the direction of the central axis is chamfered.

Figure 18:
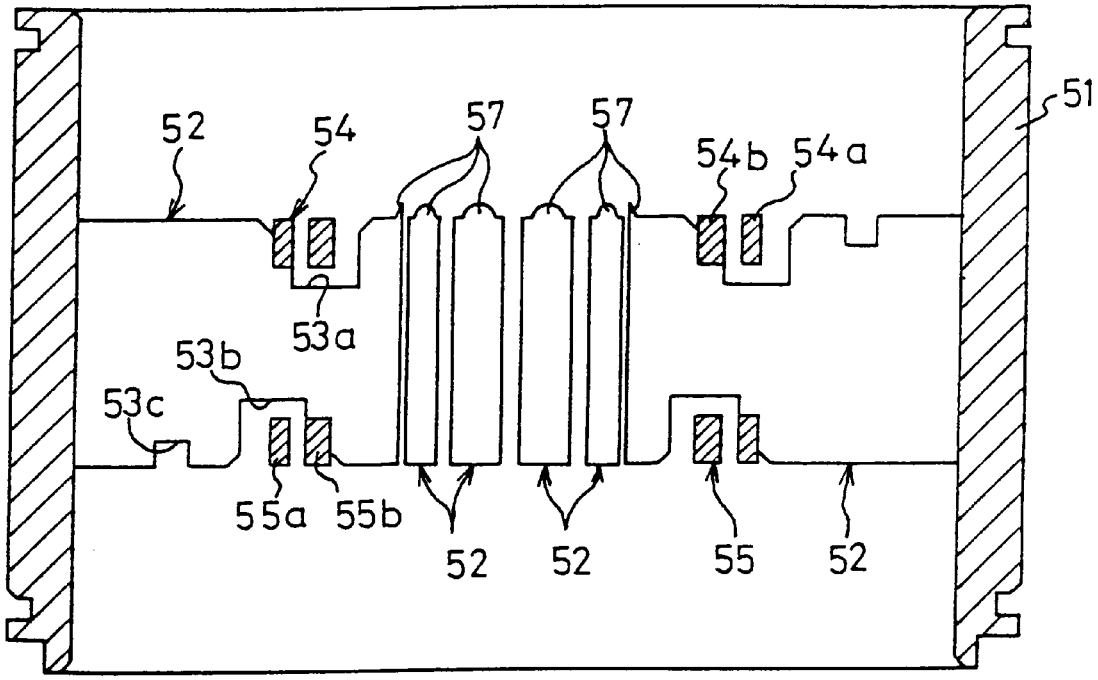
FIG. 18(PRIOR ART)
FIG. 18 is an explanatory view showing the generation of burrs in the conventional magnetron apparatus.

With this configuration, in the magnetron apparatus of this embodiment, the area of contact between the anode segments 15 and the jig pin 40 can be reduced, so that the pressure exerted on the anode segments 15 by the jig pin 40 can be reduced. Consequently, in the magnetron apparatus of this embodiment, the problems can be solved such as the deformation of the anode segments and the detachment of brazed parts due to insufficient brazing in the conventional magnetron apparatus described previously and the generation of burrs shown in FIG. 18, so that microwaves of the fundamental frequency can be oscillated with stability without any faulty oscillation. Further, in the magnetron apparatus of this embodiment, a conventionally used converntaional ordinary assembly jig such as the jig pin 40 can be used without any modification, so that the manufacture cost can be reduced due to a modification of manufacture equipment.

The jig pin 40 is made of an expensive ceramic member containing silicon nitride ($Si_3N_4$), and the surface of a cylindrical portion which is in contact with the inner end surface 21 is formed so as to be as smooth as a mirror finished surface. The outer diameter of the cylindrical portion is set so that the diameter of an inscribed circle defined by a plurality of coaxially radially arranged anode segments 15 is a value which is decided based on the theory of operation for the magnetron apparatus.

Next, technical advantages of the concave 22 will be explained concretely. In the below-mentioned description, each anode segment 15 is divided into three areas, i.e. a central area Vy having the concave 22 and upper and lower areas Vx and Vz situated above and below the central area Vy as depicted in FIG. 3.

In the anode segments 15 of this embodiment, except for the portion of the concave 22, two portions, i.e. the inner end surface 21 in the upper area Vx and the inner end surface 21 in the lower area Vz are in contact with the jig pin 40. Therefore, the pressure from the jig pin 40 is exerted only on the upper and lower areas Vx and Vz and the area of contact with the jig pin 40 can be reduced. Consequently, in the magnetron apparatus of this embodiment, the anode segments 15 can be supported in a well balanced manner at the upper and lower two portions divided in the direction of the central axis with respect to the jig pin 40, so that the assembly precision of the magnetron apparatus can be easily improved. Moreover, since the area of contact with the jig pin 40 is reduced, the flatness of the contact surface which comes into contact with the jig pin 40 can be also easily improved, so that the insertion pressure of the jig pin 40 exerted on the central portion in the direction of the arrangement of the anode segments 15 can be reduced.

Further, the strap ring grooves 20*a* and 20*b* are provided at the end surface on the longer side of each anode segment 15. Therefore, the pressure exerted on the upper and lower areas Vx and Vz by the jig pin 40 is reduced, so that the insertion pressure of the jig pin 40 exerted on the central portion in the direction of the arrangement of the anode segments 15 can be further reduced. Even if unbalance occurs in the pressure from the jig pin 40 in the upper and lower areas Vx and Vz, the unbalance can be absorbed by the portions of the strap ring grooves 20*a* and 20*b*.

Thus, in the magnetron apparatus of this embodiment, by providing the concave 22 in the central portion in the direction of the central axis of the inner end surface 21, the pressure exerted on the anode segments 15 by the jig pin 40 can be reduced and made uniform. Consequently, in the magnetron apparatus of this embodiment, the problems of the conventional magnetron apparatus can be solved such as the deformation of the anode segments and the strap rings caused at the time of assembly, the detachment of brazed parts due to insufficient brazing, the generation of burrs shown in FIG. 18 and the variation in pitch shown in FIG. 19. Thus, in accordance with this embodiment of the invention, the production of undesired oscillations can be considerably reduced using a conventional assembly jig.

Figure 17:
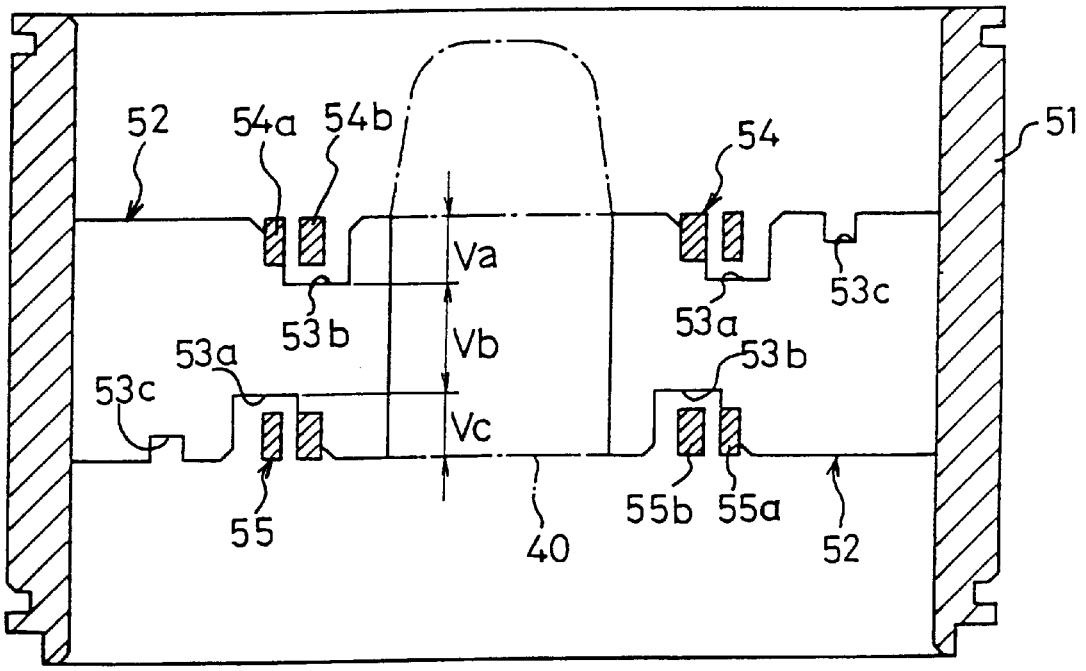
FIG. 17 (PRIOR ART)
FIG. 17 is a cross sectional view showing the configuration of the principal part of the anode assembly in the conventional magnetron apparatus after the brazing filler metal is melted.
Figure 19:
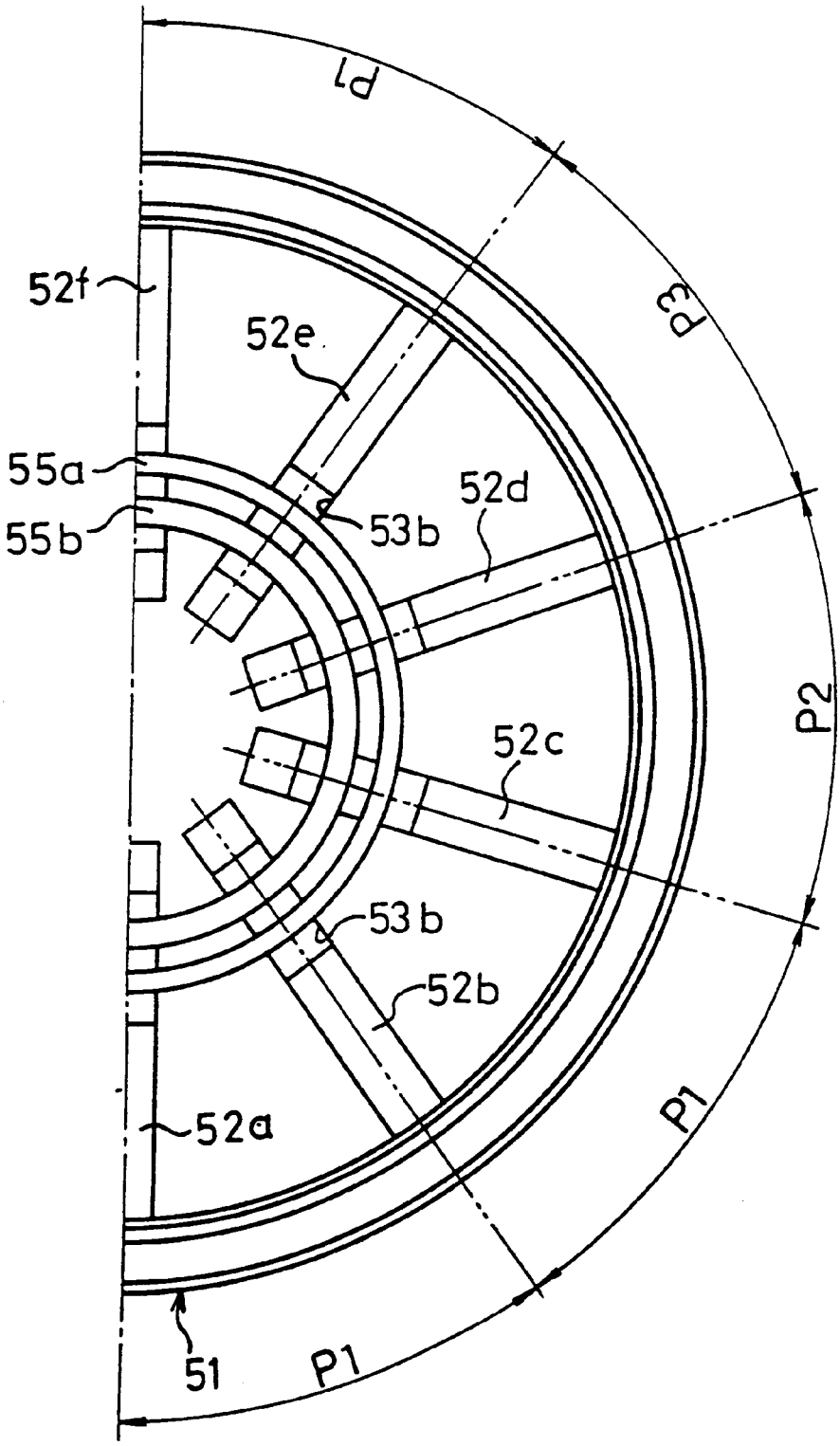
FIG. 19 (PRIOR ART)
FIG. 19 is an explanatory view showing the variation in pitch of the anode segments in the conventional magnetron apparatus.

On the contrary, in the conventional magnetron apparatus, as described previously with reference to FIG. 17, when the jig pin 40 is press-fit in the central portion in the direction of the arrangement of the anode segments, the pressing force exerted on the central area Vb is greater than that exerted on the upper and lower areas Va and Vc in the direction of the central axis of the anode segments. Therefore, in the conventional magnetron apparatus, variation in the pitch of the anode segments is caused as illustrated in FIG. 19, so that the plural anode segments are not equally spaced.

Next, the depth D and the length Hb of the concave 22 will be explained in detail.

The depth D of the concave 22 defines the distance from the inner end surface 21 each of the anode segments 15 in a direction toward the inner surface of the anode cylinder 1 (the distance in the direction of the radius) when the anode segments 15 are secured to the anode cylinder 1. The effects of reducing and making uniform the pressure exerted on the anode segments 15 by the jig pin 40 can be always obtained by providing the concave 22 so that the portion of the concave 22 is kept from contact with the jig pin 40. Therefore, the depth D of the concave 22 may be any depth as long as the portion of the concave 22 can be always kept from contact with the jig pin 40.

Therefore, in view of the deformation of the anode segments 15 at the time of expansion, it is necessary that the depth D of the concave 22 be not less than approximately 0.1 mm. For mass production, in view of the dimensional tolerance of the anode segments 15 and variation due to the press manufacturing method, it is necessary that the depth D be not less than 0.2 mm.

The length Hb of the concave 22 defines the length in the direction of the central axis when the anode segments 15 are secured to the anode cylinder 1. The inventors have found through an examination that it is necessary that the ratio of the length Hb to a length of the anode segments 15 in the direction of the central axis, i.e. the length Ha of the inner end surfaces 21 be not less than 20% in order to improve the assembly precision of the anode assembly by reducing and uniformizing the pressure exerted on the anode segments 15 by the jig pin 40.

Further, in view of the fact that the pressure from the jig pin 40 is absorbed by the anode segments 15, it is most desirable to provide the concave 22 to all the central portions in the direction of the central axis of the anode segments 15 which central portions are not opposed to the strap ring grooves 20*a* and 20*b*. That is, as shown in FIG. 3, when the length of the strap ring grooves 20*a* and 20*c* is Hc, it is most desirable to form the concave 22 so that a relationship Hb=Ha−2×Hc holds. In the anode segments 15 of a typical magnetron apparatus, since the length Hc is 10 to 30% of the length Ha, the ratio of the length Hb to the length Ha is approximately 40 to 80%.

On the other hand, when the concave 22 is provided at the inner end surface 21 each of the anode segments 15 in a magnetron apparatus, the distance from the cathode 14 disposed in the central portion in the direction of the arrangement increases at the portion of the concave 22 during operation of the magnetron apparatus. Thereby, there is a possibility that the magnetron efficiency is reduced. Accordingly, in view of the magnetron efficiency, it is desirable that the length Hb of the concave 22 be as small as possible.

Here, a relationship between magnetron efficiency and the depth D and the length Hb of the concave 22 obtained through an experiment by the inventors will be described with reference to FIG. 4.

Figure 4:
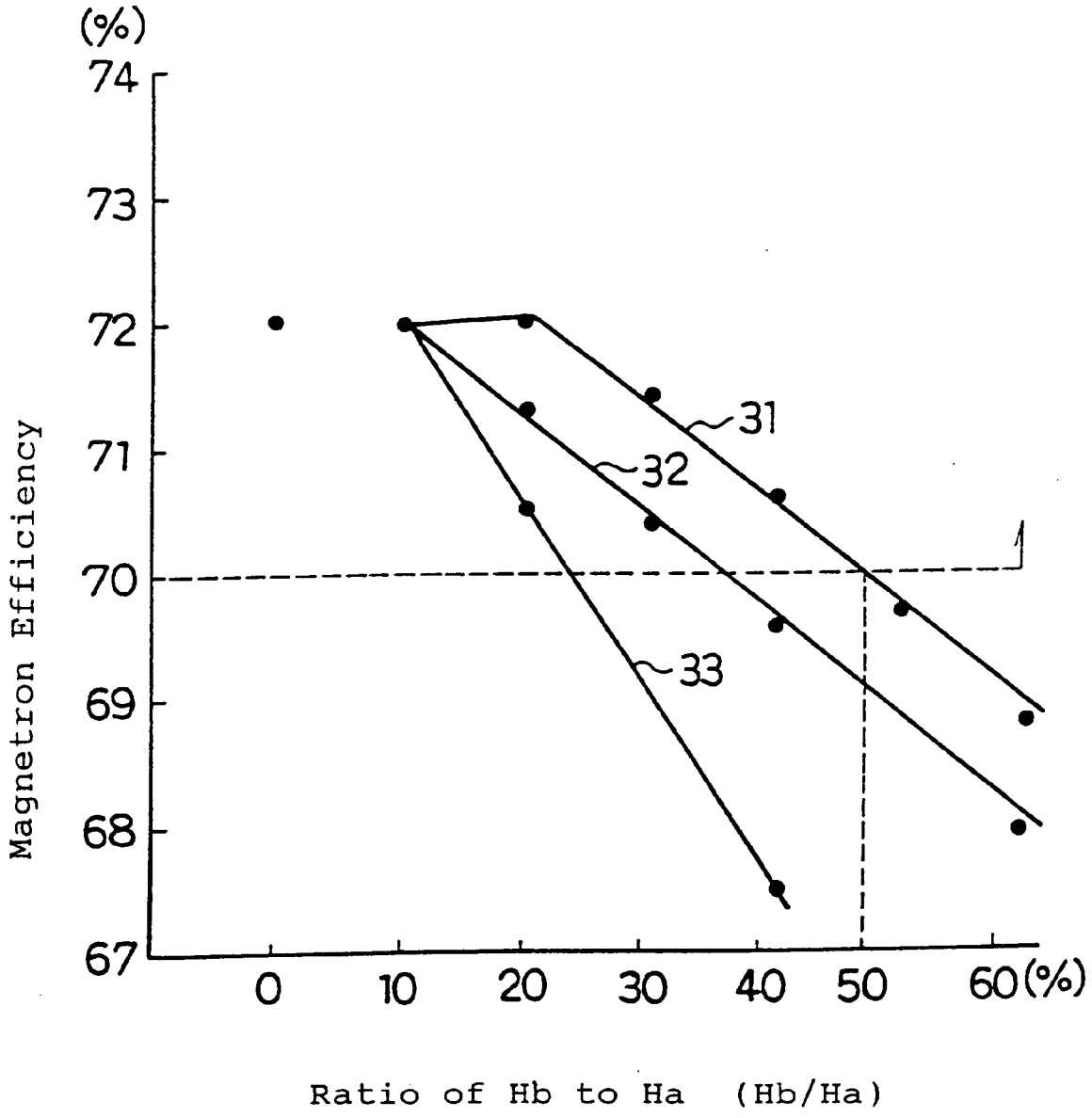
FIG. 4 is a graph showing a relationship between magnetron efficiency and the ratio of a length Hb to a length Ha.

FIG. 4 is a graph showing a relationship between magnetron efficiency and the ratio of the length Hb to the length Ha. Graphs 31, 32 and 33 shown in FIG. 4 are results of the experiment when the depth D of the concave 22 is 0.2 mm, 0.3 mm and 0.4 mm, respectively.

As is apparent from the graphs 31, 32 and 33 of FIG. 4, as the ratio of the length Hb of the concave 22 to the length Ha of the inner end surface 21 is greater, the magnetron efficiency is lower, and as the depth D of the concave 22 is greater, the deterioration of the magnetron efficiency is greater. In the magnetron apparatus, magnetron efficiency of not less than approximately 70% is required in practical use as well known. Therefore, when the depth D of the concave 22 is set to 0.2 mm in view of the dimensional tolerance at the time of mass production, it is desirable that the length Hb of the concave 22 be set to less than 50% of the length Ha of the inner end surface 21.

From the above-described examination results, it is apparent that the ratio of the length Hb of the concave 22 to the length Ha of the inner end surface 21 is desirably selected and set so as to be 20 to 50%.

Further, according to an experiment by the inventors, for example, a magnetron apparatus for a microwave oven with an output of 500 to 1000 W was produced. Therein, the magnetron apparatus (hereinafter, referred to as experimental product 1) had the anode segments 15 in which the length Ha of the inner end surface 21 is 9.5 mm, the depth Hc of the strap ring grooves 20*a* and 20*b* is 2.6 mm, the depth D of the concave 22 is 0.2 mm and the length Hb of the concave 22 is 4.0 mm (Hb/Ha=42%). In the experimental product 1, results which are sufficient for practical use were obtained such that the assembly precision is sufficient and the magnetron efficiency is approximately 71%.

Figure 5:
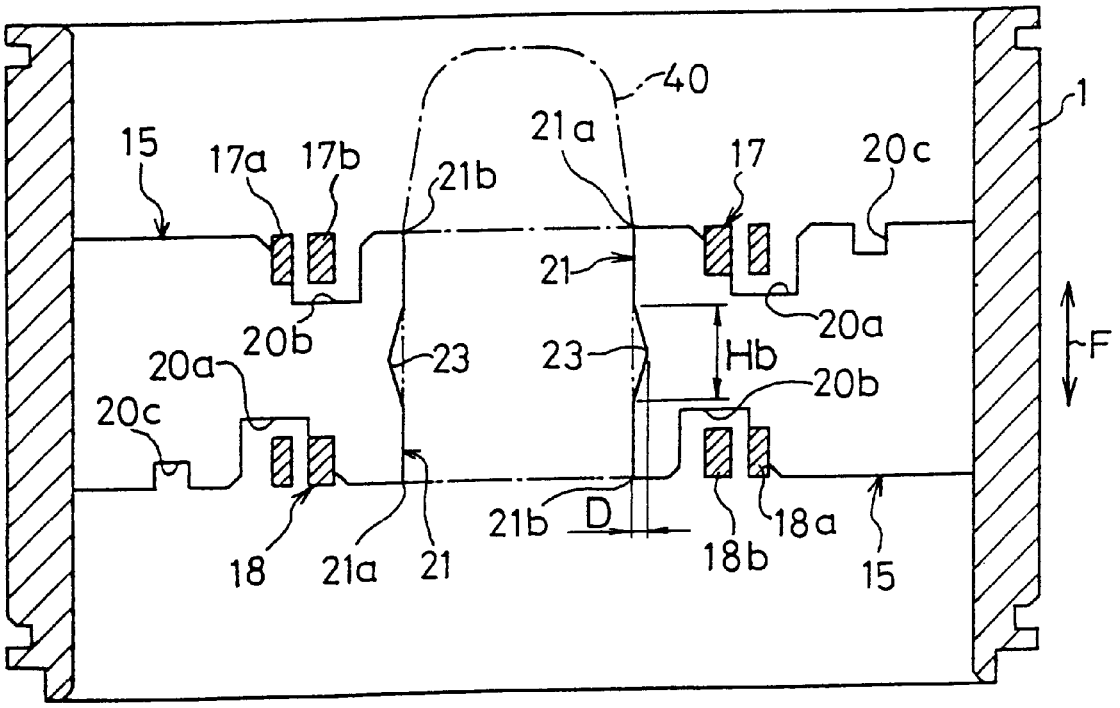
FIG. 5 is a view showing a configuration of a modified version of the anode segment shown in FIG. 3.
Figure 6:
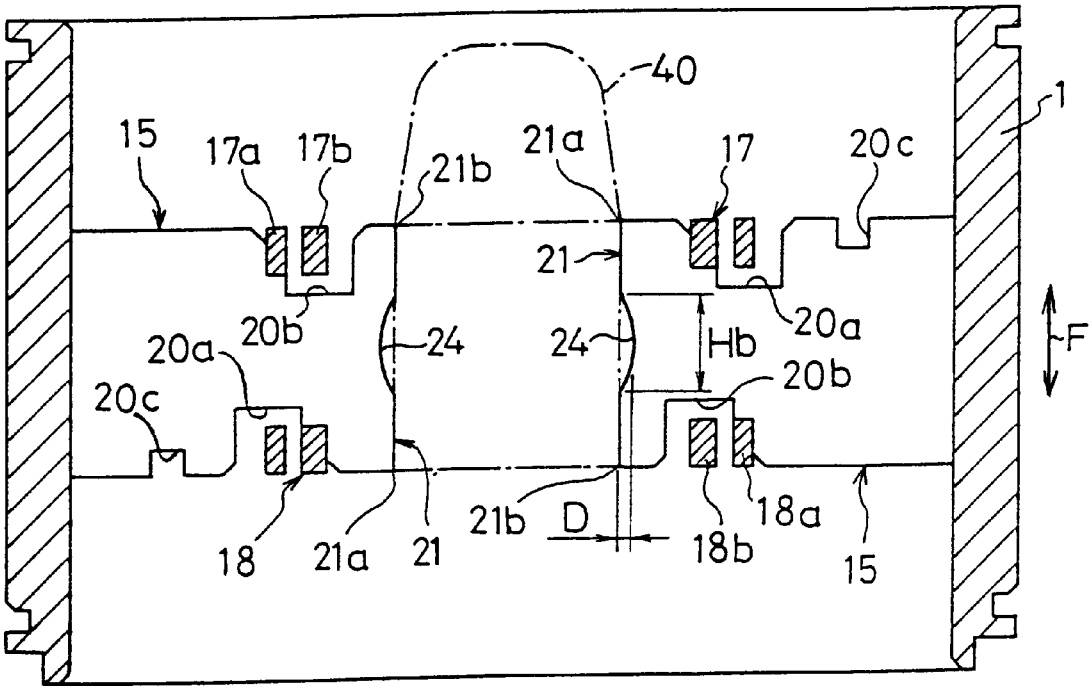
FIG. 6 is a view showing a configuration of another modified version of the anode segment shown in FIG. 3.

In the above-mentioned description, the opening configuration of the concave 22 of each anode segments 15 is rectangular. However, the opening configuration may have any configuration as long as there is a predetermined spatial distance in the central portion in the direction of the central axis each of the anode segments 15, and concaves 23, 24 may have a tapered opening configuration 23 or a circular opening configuration 24 as shown in FIG. 5 and FIG. 6, respectively. At this time, the depth D is a distance from a point in the concaves 23, 24 which are farthest from the inner end surface 21, and the length Hb is the size of the widest part of the concaves 23, 24, i.e. the size of the concaves 23, 24 at the inner end surface 21 each of the anode segments 15.

In the above-mentioned description, the anode segments 15 are pressed against the inner surface of the anode cylinder 1 by use of the jig pin 40 having the cylindrical portion which comes into contact with a plurality of the inner end surfaces 21. However, the jig pin 40 is not limited to the one having the cylindrical portion, but any assembly member may be used that is designed so as to come into contact with the inner end surface 21 each of the anode segments 15.

[Manufacturing Method]

In the manufacturing method for the magnetron apparatus of this embodiment, first, the plural anode segments 15 and the strap rings 17 and 18 are placed in the respective predetermined positions inside the anode cylinder 1 by use of a non-illustrated temporary assembling jig. Then, the jig pin 40 is moved along the central axis of the anode cylinder 1 and press-fit from below into the central portion in the direction of the arrangement of the anode segments 15 (the central portion of the anode cylinder 1) as shown by the arrow Y of FIG. 2. So that the jig pin 40 contacts with the inner end surface 21 each of the anode segments 15. Thereby, the anode assembly is maintained in a preassembled condition where the one end surface each of the anode segments 15 is pressed against the inner surface of the anode cylinder 1 by the jig pin 40. Then, only the temporary assembling jig is detached, and the brazing filler metal 19 is put on the end surface on the longer side each of the anode segments 15 so as to be in contact with the inner surface of the anode cylinder 1 as shown in FIG. 2. After the magnetic pole piece 2 is attached to the upper open end of the anode cylinder 1, one end of the antenna 16 is mounted to one of the anode segments 15 (see FIG. 1). Then, the anode assembly in the preassembled condition is heated to a predetermined temperature (for example, 800 to 900° C.) in a non-illustrated furnace. Thereby, the brazing filler metal 19 is melted and flows into a clearance between the inner surface of the anode cylinder 1 and the one end surface each of the anode segments 15 caused by expansion. At this time, the plating layers on the strap rings 17 and 18 and the antenna 16 are also melted. Then, by taking the anode assembly out of the furnace while maintaining the preassembled condition, and cooling it, the inner surface of the anode cylinder 1 and the one end surface each of the anode segments 15, the strap ring grooves 20*a* and 20*b* and the strap rings 17 and 18, and the antenna 16 and the one of the anode segments 15 are secured. Then, after the jig pin 40 is downwardly pulled out, the magnetic pole piece 3 is attached to the lower open end of the anode cylinder 1 (see FIG. 1), so that the assembly of the anode assembly is finished.

In the manufacturing method for the magnetron apparatus of this embodiment, because of the provision of the concave 22 in the central portion of the inner end surface 21 each of the anode segments 15, the area of contact between the inner end surface 21 and the jig pin 40 is smaller than in the conventional apparatus, so that the pressure exerted on the anode segments 15 by the jig pin 40 is reduced. Consequently, the pressure exerted on the two pairs of the strap rings 17 and 18 situated at the upper and lower ends in the direction of the central axis each of the anode segments 15 is smaller than in the conventional apparatus, so that the brazing precision improves and the deformation of the strap rings 17 and 18 and the coming-off of brazed parts due to insufficient brazing can be prevented during the while the jig pin 40 being press-fit and taken out.

The pressure which the anode segments 15 from the jig pin 40 is dispersed and uniformized into the upper and lower areas Vx and Vz in the direction of the central axis because the concave 22 is provided in the central portion in the direction of the central axis. Further, since the strap ring grooves 20*a* and 20*b* are provided in the upper and lower areas Vx and Vz, even if the anode segments 15 expand due to temperature increase at the time of brazing, the expanded portions are absorbed by the strap ring grooves 20*a* and 20*b*, so that the pressure is equally exerted.

Particularly, since the central area Vy each of the anode segments 15 includes a spatial distance defined by the depth D of the concave 22 from the jig pin 40, even if outer dimension variation or expansion of the anode segments 15 is caused, no pressure is exerted on the central area Vy by the jig pin 40. Therefore, even if the anode segments 15 expand when heated, the pressures exerted on the upper and lower areas Vx and Vz are similar. Consequently, the anode segments 15 can be pressed against the jig pin 40 always in a stable condition at the two portions of the upper and lower areas Vx and Vz, so that even if the jig pin 40 has a surface which is as smooth as a mirror finished surface, the variation in pitch as illustrated in FIG. 19 is never caused. That is, in the manufacturing method for the magnetron apparatus of this embodiment, the plural anode segments 15 can be equally spaced in the anode cylinder 1, so that the magnetron apparatus which operates with stability can be obtained.

As has been explained in the above, according to the manufacturing method for the magnetron apparatus of the present invention, the precision with which the anode assembly is assembled can be easily improved without modifying the process from the preassembly to the brazing by use of the conventional ordinary assembly jig as it is without any modification. Particularly, as the jig pin 40 which is expensive because high heat resistance and high wear resistance are required therefor, a conventional temporary assembling pin can be used as it is without any modification, so that the manufacture cost is prevented from greatly increasing.

<<Second Embodiment>>

Figure 7:
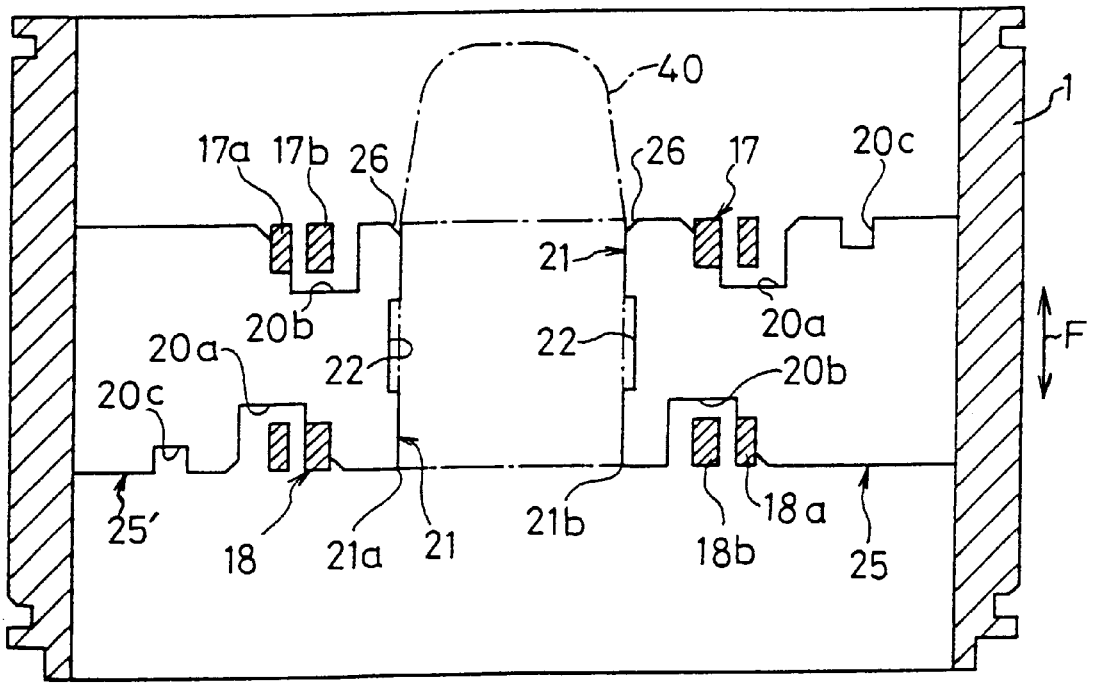
FIG. 7 is a cross sectional view showing a configuration of a principal part of an anode assembly of a magnetron apparatus in a second embodiment of the present invention.

FIG. 7 is a cross sectional view showing a configuration of a principal part of an anode assembly of a magnetron apparatus in a second embodiment of the present invention. In this embodiment, in the configuration of the magnetron apparatus, a chamfered portion is provided in which at least one angular portion of the inner end surface each of the anode segments is chamfered. The other elements and portions are similar to those of the first embodiment, and therefore overlapping descriptions on the similar points are omitted from the description of this figure.

As shown in FIG. 7, in the magnetron apparatus of this embodiment, a tapered chamfered portion 26 is provided at one angular portion of the inner end surface 21 each of anode segments 25 and 25', and the anode segments 25 and 25' are secured to the inner surface of the anode cylinder 1 so that the chamfered portions 26 are situated at the upper side in the direction of the central axis. That is, in the anode segment 25, the chamfered portion 26 is formed by chamfering an angular portion at which the inner end surface 21 intersects the end surface where the strap ring groove 20*a* is provided. In the anode segment 25', the chamfered portion 26 is formed by chamfering an angular portion at which the inner end surface 21 intersects the end surface where the strap ring groove 20*b* is provided. By providing such a chamfered portion 26, in the magnetron apparatus of this embodiment, the area of contact between the jig pin 40 and the anode segments 25 and 25' is smaller than in the first embodiment, so that the pressure exerted on the anode segments 25 and 25' by the jig pin 40 can be reduced.

Figure 8:
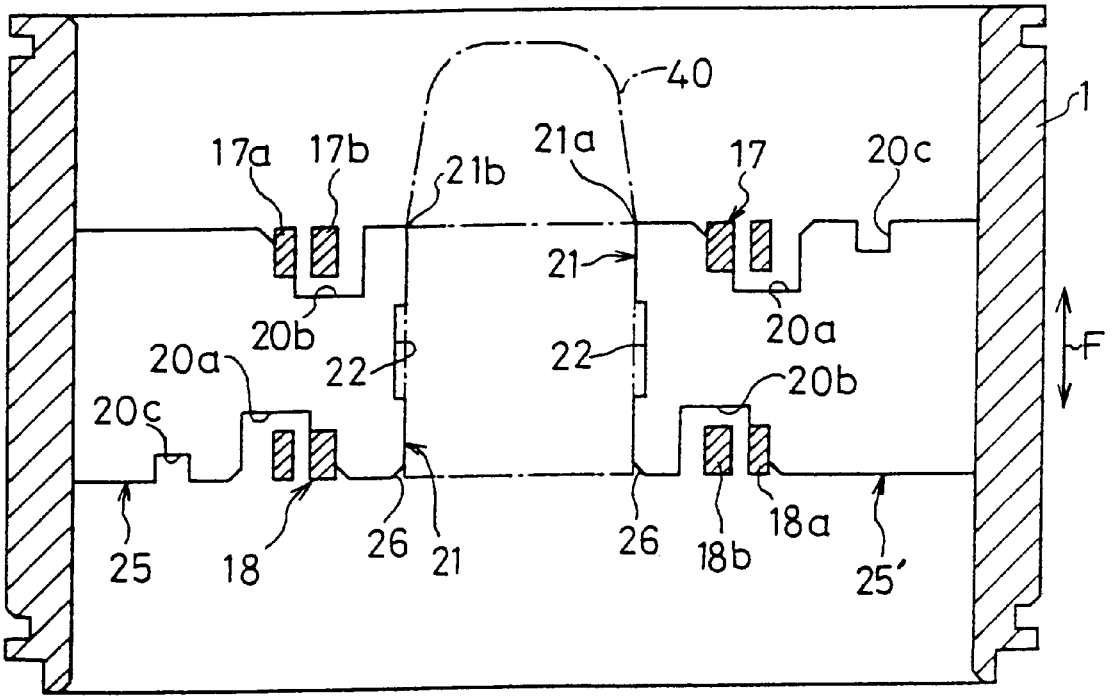
FIG. 8 is a view showing a configuration of a modified version of the anode assembly shown in FIG. 7.

Moreover, as shown in FIG. 8, the anode segments 25 and 25' may be secured to the inner surface of the anode cylinder 1 so that the chamfered portions 26 are situated at the lower side in the direction of the central axis.

Figure 9:
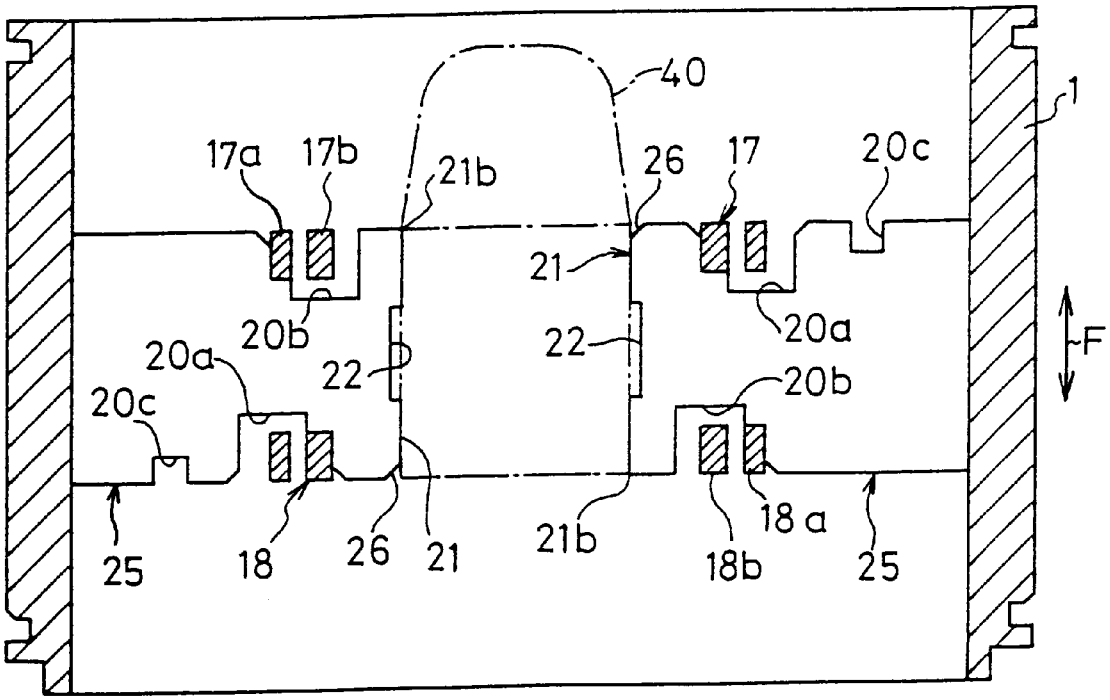
FIG. 9 is a view showing a configuration of another modified version of the anode assembly shown in FIG. 7.
Figure 10:
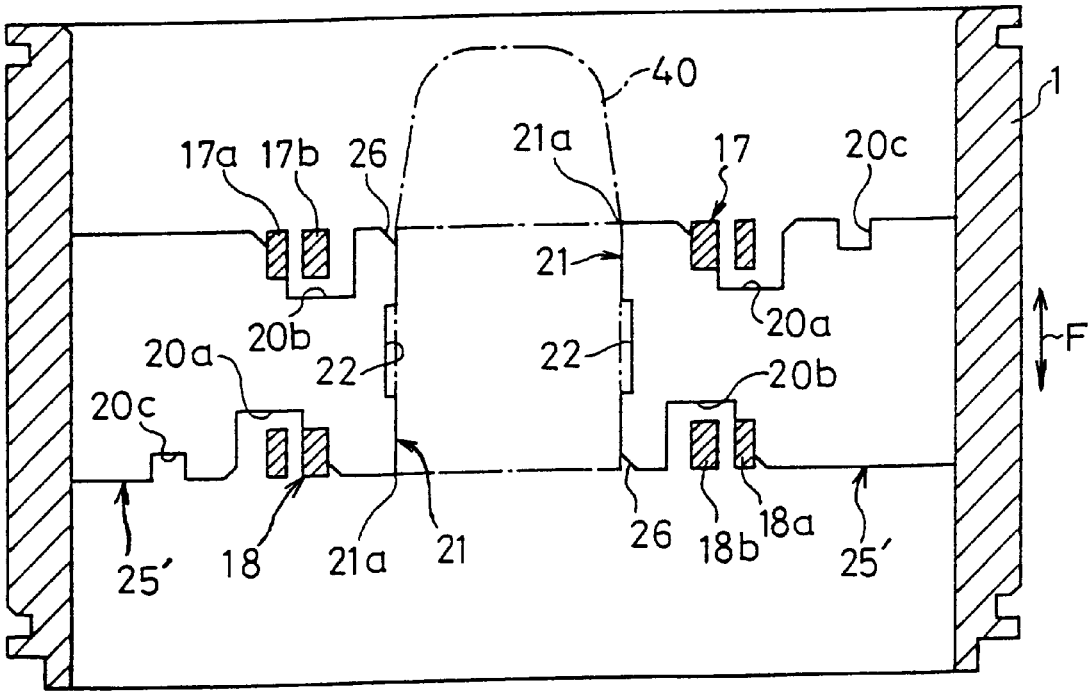
FIG. 10 is a view showing a configuration of another modified version of the anode assembly shown in FIG. 7.

Further, as shown in FIG. 9 and FIG. 10, the anode segments which are secured to the inner surface of the anode cylinder 1 may be only one kind of the two anode segments 25 and 25' (see FIG. 9).

Figure 11:
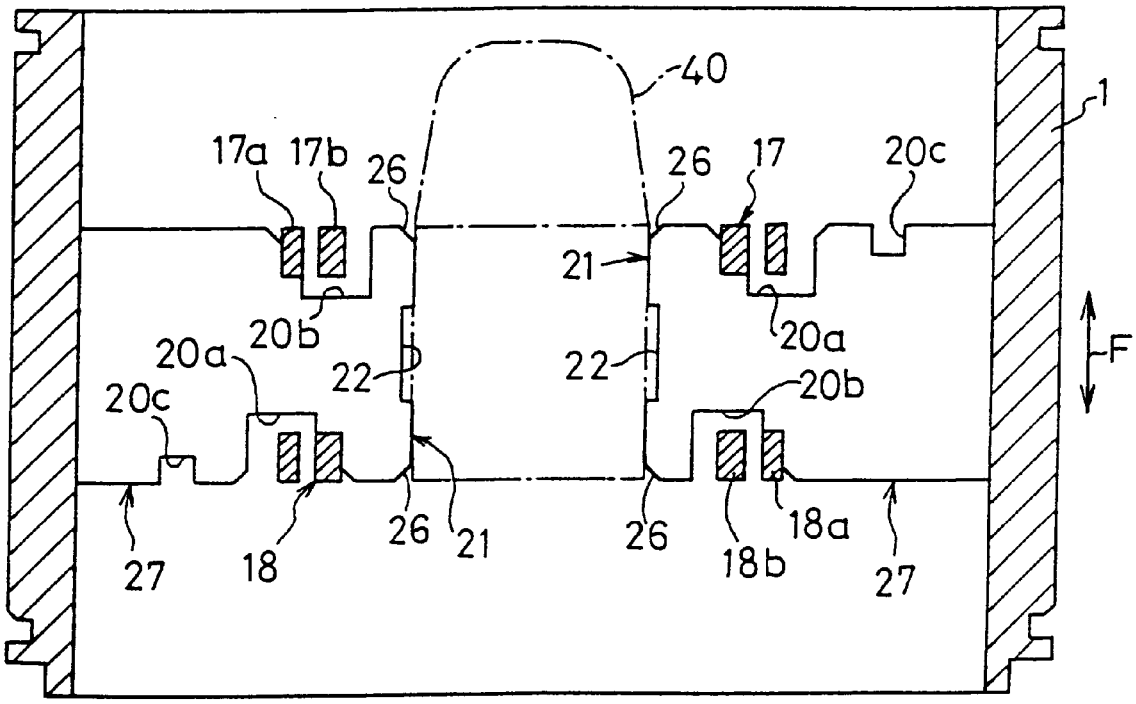
FIG. 11 is a view showing a configuration of another modified version of the anode assembly shown in FIG. 7.

Moreover, as shown in FIG. 11, an anode segment 27 in which the chamfered portion 26 is provided at the angular portion at each of the upper and lower ends of the inner end surface 21 in the direction of the central axis may be secured to the inner surface of the anode cylinder 1.

In the anode assemblies shown in FIG. 7 to FIG. 10, the contact area can be reduced by substantially the same extent. In the anode assemblies shown in FIG. 8 and FIG. 11, since the chamfered portion 26 is situated at the side where the jig pin 40 is inserted, the jig pin 40 is more easily inserted than in the other anode assemblies.

In a conventional anode assembly for the magnetron apparatus, typically, anode segments of the same configuration are arranged so that every two anode segments are vertically inverted. However, when the anode segments 25 and 25' shown in FIG. 7 and FIG. 8 are used, it is necessary to select those anode segments 25 and 25' and arranged them alternately. On the other hand, when the anode segments 27 shown in FIG. 11 are used, since the chamfered portion 26 is provided at the angular portion at each of the upper and lower ends of the inner end surface 21, the selection of anode segments is unnecessary, so that the time necessary for assembling the anode assembly can be reduced the most. Further, the contact area can be reduced the most and the insertion of the jig pin 40 is facilitated. Thus, the anode segments 27 are most suitable for practical use.

According to an experiment by the inventors, in the anode segments 27 for use in the magnetron apparatus for the microwave oven with an output of 500 to 1000 W, the most desirable result where the magnetron efficiency is the highest was obtained when the chamfered portion 26 of C=0.2 to 0.6 mm was provided at each of the upper and lower ends of the inner end surface 21, where C is the length of one edge of the chamfer.

As described above, in the magnetron apparatus of this embodiment, the chamfered portion 26 is provided on at least one angular portion of the inner end surface 21. Thereby, the area of contact between the anode segments and the jig pin 40 is smaller than in the first embodiment, so that the aforementioned deformation of the anode segments and the strap rings 17 and 18, the detachment of brazed parts due to insufficient brazing and the generation of burrs due to nonuniformity of components can be further reduced.

In the above description, the tapered chamfered portion 26 is provided at the inner end surface 21 which faces the jig pin 40. However, the configuration of the chamfered portion is not limited to the tapered configuration as long as the dimension in the direction of the central axis of the inner end surface 21 which faces the jig pin 40 can be reduced. For example, a circular chamfered portion may be provided.

Further, in the above description, the chamfered portion 26 is provided on at least 21 one of the upper and lower ends of the inner end surface in the direction of the central axis. However, the chamfered portion may be provided at an angular portion which faces the concave 22 of the inner end surface 21.

Test results on noise characteristics of the magnetron apparatus of the present invention will be explained with reference to FIG. 12 to FIG. 15.

Figure 12:
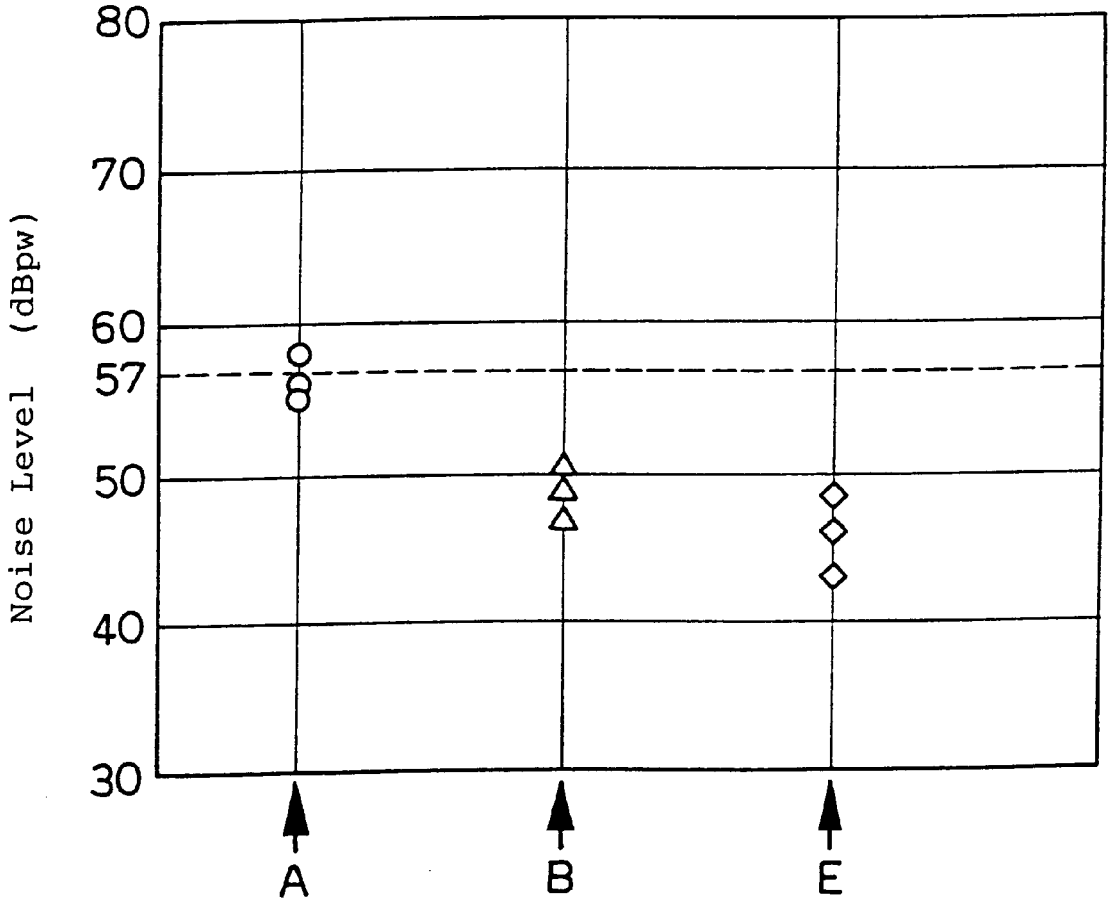
FIG. 12 is a graph showing measurement results of the noise level at the fifth harmonic.
Figure 13:
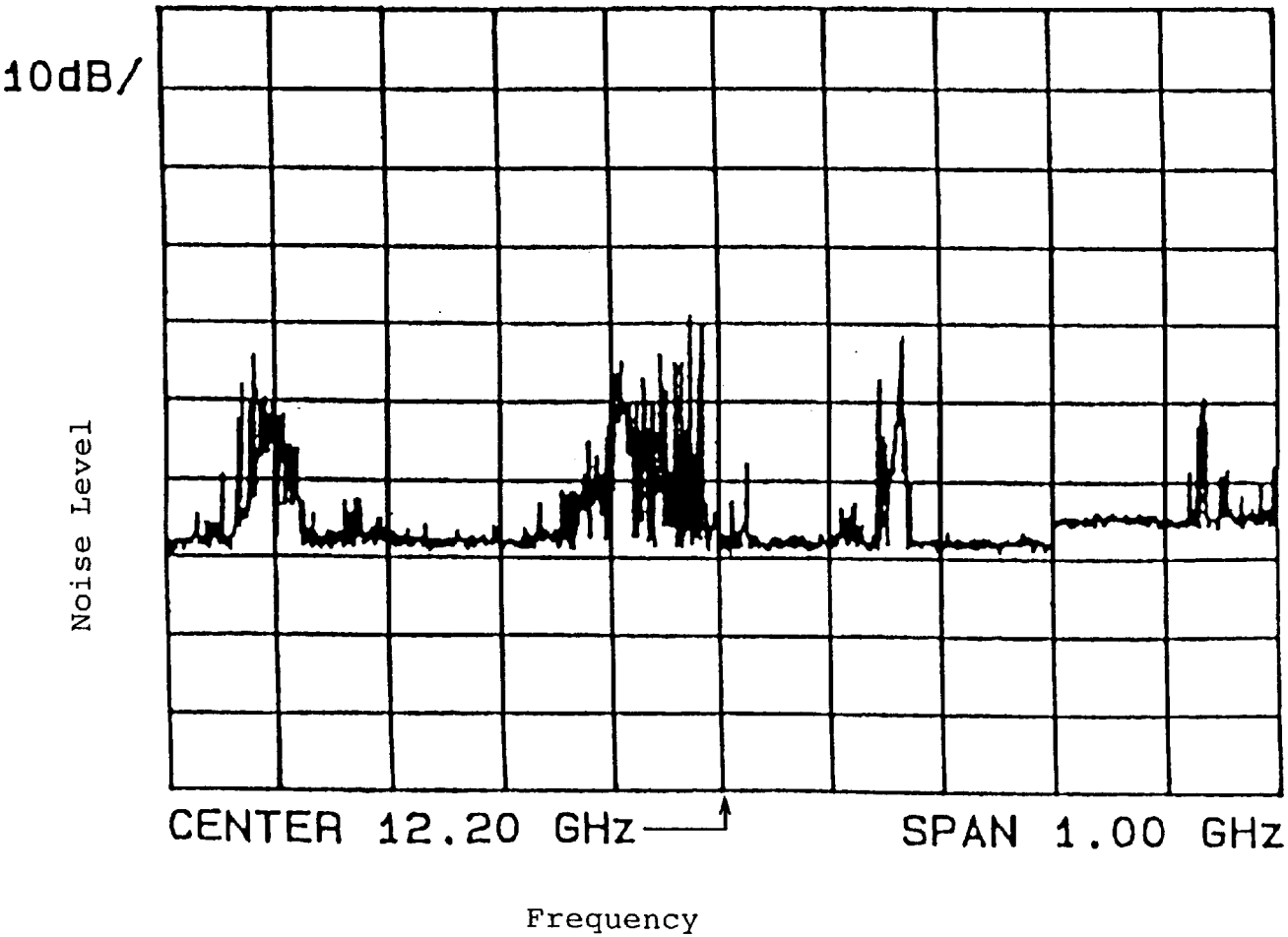
FIG. 13(PRIOR ART)
FIG. 13 is a measurement result showing noise characteristics in the vicinity of the fifth harmonic in the conventional magnetron apparatus shown in FIG. 16.
Figure 14:
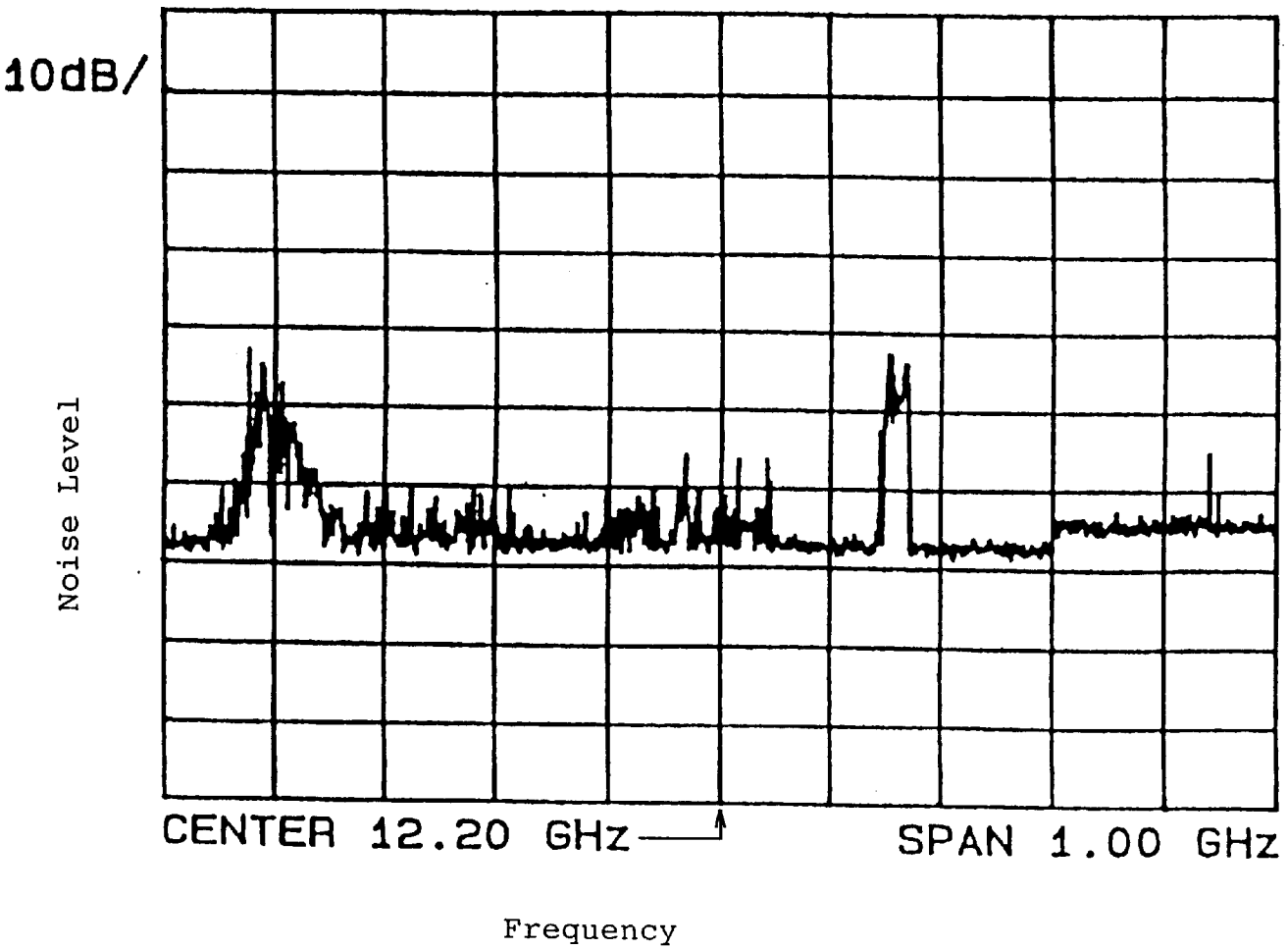
FIG. 14 is a measurement result showing noise characteristics in the vicinity of the fifth harmonic in the magnetron apparatus of the first embodiment.
Figure 15:
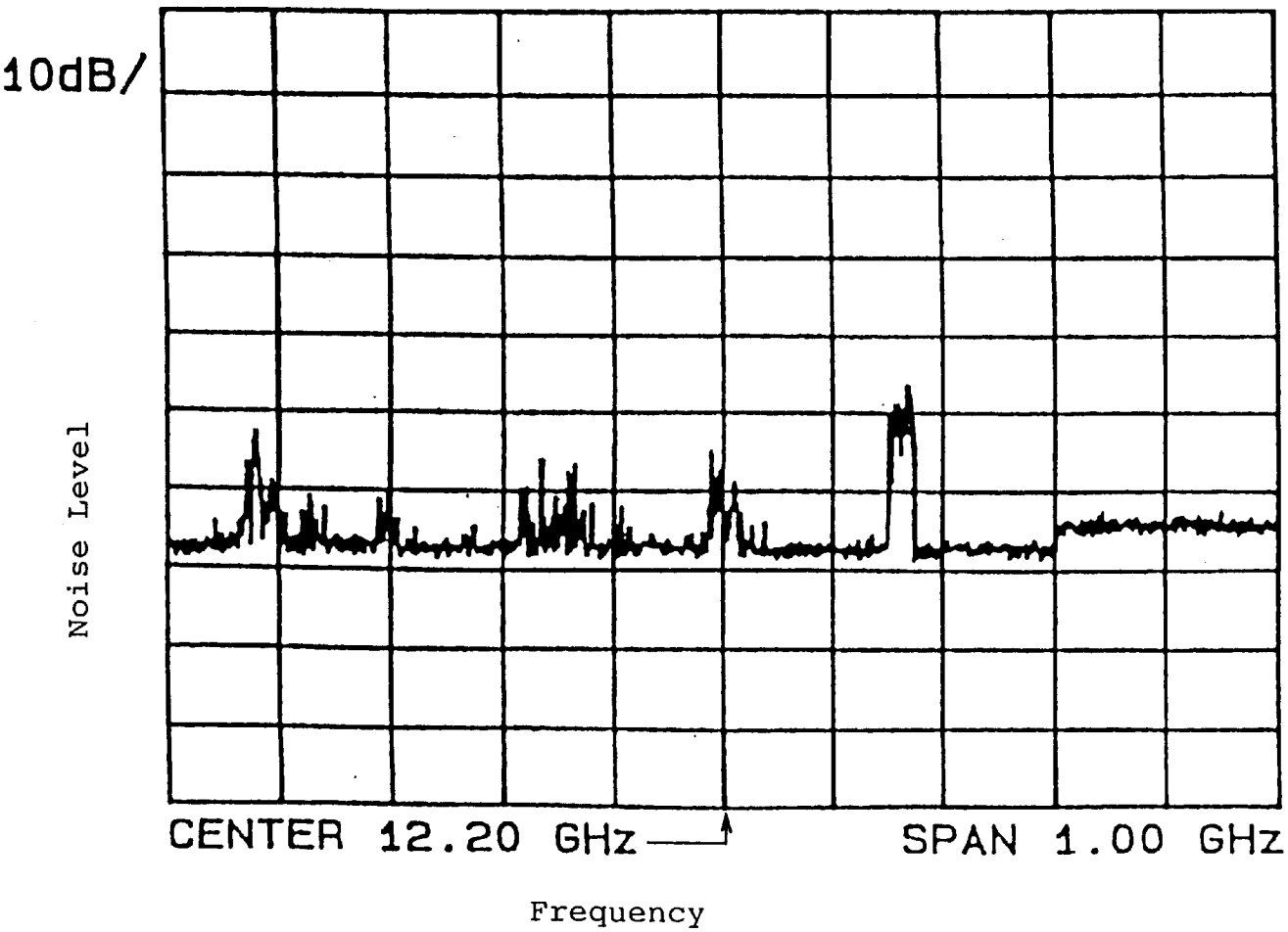
FIG. 15 is a measurement result showing noise characteristics in the vicinity of the fifth harmonic in the magnetron apparatus of the second embodiment.

FIG. 12 is a graph showing measurement results of the noise level at a fifth harmonic. FIG. 13 is a measurement result showing noise characteristics in the vicinity of the fifth harmonic in the conventional magnetron apparatus shown in FIG. 16. FIG. 14 is a measurement result showing noise characteristics in the vicinity of the fifth harmonic in the magnetron apparatus of the first embodiment. FIG. 15 is a measurement result showing noise characteristics in the vicinity of the fifth harmonic in the magnetron apparatus of the second embodiment.

Figure 16:
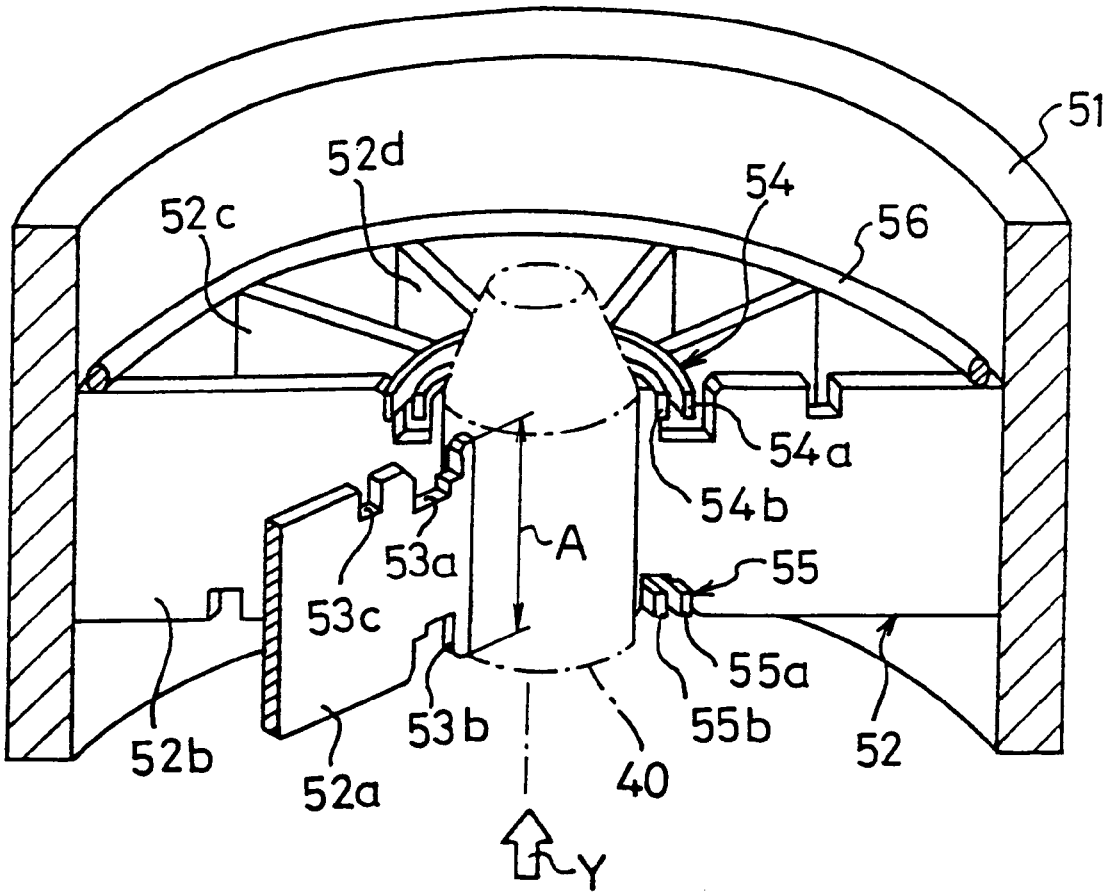
FIG. 16(PRIOR ART)
FIG. 16 is a partially cutaway perspective view showing a configuration of a principal part of an anode assembly in a conventional magnetron apparatus before a brazing filler metal is melted.

In this test, three kinds of magnetron apparatuses, i.e. the aforementioned experimental product 1 of the first embodiment, an experimental product 2 of the second embodiment in which the chamfered portion 26 of C=0.5 mm is provided in each anode segment of the experimental product 1, and the conventional apparatus shown in FIG. 16 were operated at a fundamental frequency of 2,450 MHz, and noise levels at the fifth harmonic 12.25 GHz and at frequencies in the vicinity thereof were measured. This is because the fifth harmonic of such magnetron apparatuses falls within the frequency range (11.7 to 12.7 GHz) of the satellite broadcasting band on which strict regulation has been imposed in recent years. In this test, it was examined whether the standard of CISPR (International Special Committee on Radio Interference) was satisfied or not. Specifically, the effective radiated power of electromagnetic waves within the frequency range of 11.7 to 12.7 GHz was measured with a half-wave dipole antenna as the reference, and it was examined whether or not the measurement results were not more than 57 dB which is the permissible electric power of the radio frequency radiation jamming wave defined by the standard.

As a result, in the experimental products 1 and 2, the measurement results of the noise level at the fifth harmonic were 47 to 51 dB and 43 to 48 dB, respectively, as shown at B and E of FIG. 12, and both were below the permissive value 57 dB and satisfied the CISPR standard. Moreover, it was found that the experimental product 2 having the anode segments 27 provided with the chamfered portion 26 was more effective for reducing the noise level at the fifth harmonic than the experimental product 1. On the contrary, in the conventional apparatus, the measurement results were 55 to 58 dB as shown at A of FIG. 12 and the CISPR standard was not satisfied.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A magnetron apparatus comprising:

an anode cylinder having a central axis; and a plurality of plate-shaped anode segments radially arranged around the central axis of said anode cylinder, wherein each of said plurality of plate-shaped anode segments includes a first edge, a second edge, a third edge, and a fourth edge, said first edge of each of said anode segments being attached to an inner surface of said anode cylinder in a substantially longitudinal orientation with respect to said anode cylinder so that each said anode segment projects radially inward toward said central axis from said inner surface, said second edge of each of said anode segments opposing said corresponding first edge and being arranged in a substantially longitudinal orientation with respect to said anode cylinder, said third edge of each of said anode segments connecting a first end of said corresponding first edge and a first end of said corresponding second edge, and said fourth edge of each of said anode segments connecting a second end of said corresponding first edge and a second end of said corresponding second edge, wherein said third edge and fourth edge of each of said anode segments include at least one strap ring groove for carrying at least one conductive strap ring, each strap ring groove having a groove depth with respect to a corresponding edge of each said plate-shaped anode segment;

wherein said second edge of each of said plurality of plate-shaped anode segments is divided into three portions in a substantially longitudinal direction with respect to said anode cylinder, said three portions of each of said anode segments including a first end portion of each of said anode segments, a second end portion of each of said anode segments, and a central portion of each of said anode segments located between said corresponding first and second end portions, said central portion of each of said anode segments being fully recessed from said first and second end portions of each of said anode segments in a direction toward said corresponding first edge, said central portion of each of said anode segments having a length in a substantially longitudinal direction with respect to said anode cylinder that is based upon a respective groove depth of a corresponding strap ring groove; and for each of said anode segments, said length of said central portion of said second edge is no greater than a difference between a total length of said corresponding first edge and a sum of the respective groove depths of said corresponding strap ring grooves on said corresponding third and fourth edges.

2. A magnetron apparatus in accordance with claim 1, wherein said length of said central portion of said second edge of each of said plurality of plate-shaped anode segments is 20 to 50% of a length of said corresponding second edge.

3. A magnetron apparatus in accordance with claim 1, wherein a respective chamfered portion is provided on at least one end of said second edge of each of said plurality of plate-shaped anode segments, said respective chamfered portion having a length in a substantially longitudinal direction with respect to a corresponding said anode cylinder of between 0.2 and 0.6 millimeters.

4. A magnetron apparatus in accordance with claim 1, wherein:

for each of said anode segments said length of said central portion is approximately equal to said difference between said length of said corresponding first edge and said sum of the respective groove depths of said corresponding strap ring grooves on said corresponding third and fourth edge.

5. A magnetron apparatus in accordance with claim 1, wherein:

for each of said anode segments said length of said central portion is considerably less than said difference between said length of said corresponding first edge and said sum of the respective groove depths of said corresponding strap ring grooves on said corresponding third and fourth edge.

6. A magnetron apparatus comprising:

an anode cylinder having a central axis; and a plurality of plate-shaped anode segments radially arranged around the central axis of said anode cylinder, wherein each of said plurality of plate-shaped anode segments includes a first edge, a second edge, a third edge, and a fourth edge, said first edge of each of said anode segments being attached to an inner surface of said anode cylinder in a substantially longitudinal orientation with respect to said anode cylinder so that said anode segment projects radially inward toward said central axis from said inner surface, said second edge of each of said anode segments opposing said corresponding first edge and being arranged in a substantially longitudinal orientation with respect to each said anode cylinder, said third edge of each of said anode segments connecting a first end of said corresponding first edge and a first end of said corresponding second edge, and said fourth edge of each of said anode segments connecting a second end or said corresponding first edge and a second end of said corresponding second edge, wherein said third edge and fourth edge of each of said anode segments include at least one strap ring groove for carrying at least one conductive strap ring, each strap ring groove having a respective groove depth with respect to a corresponding edge of each said plate-shaped anode segment;

wherein said second edge of each of said plurality of plate-shaped anode segments is divided into three portions in a substantially longitudinal direction with respect to said anode cylinder, said three portions of each of said anode segments including a first end portion, a second end portion, and a central portion located between said corresponding first and second end portions, said central portion of each of said anode segments being fully recessed from said corresponding first and second end portions in a direction toward said corresponding first edge, said central portion of each of said anode segments having a length in a substantially longitudinal direction with respect to said anode cylinder; and said length of said central portion of each of said anode segments is approximately equal to the difference between the length of the corresponding first edge and the sum of the respective groove depths of said corresponding strap ring grooves on said corresponding third edge and fourth edge.

7. A magnetron apparatus in accordance with claim 6, wherein said length of said central portion of said second edge of each of said plurality of plate-shaped anode segments is 20 to 50% of a length of said corresponding second edge.

8. A magnetron apparatus in accordance with claim 6, wherein a respective chamfered portion is provided on at least one end of said second edge of each of said plurality of plate-shaped anode segments, said respective chamfered portion having a length in a substantially longitudinal direction with respect to said anode cylinder of between 0.2 and 0.6 millimeters.

9. A magnetron apparatus comprising:

an anode cylinder having a central axis; and a plurality of plate-shaped anode segments radially arranged around the central axis of said anode cylinder, wherein each of said plurality of plate-shaped anode segments includes a first edge, a second edge, a third edge, and a fourth edge, said first edge of each of said anode segments being attached to an inner surface of said anode cylinder in a substantially longitudinal orientation with respect to said anode cylinder so that each of said plurality of a node segments projects radially inward toward said central axis from said inner surface, said second edge of each of said anode segments opposing said corresponding first edge and being arranged in a substantially longitudinal orientation with respect to each said anode cylinder, said third edge of each of said anode segments connecting a first end of said corresponding first edge and a first end of said corresponding second edge, and said fourth edge of each of said anode segments connecting a second end of said corresponding first edge and a second end of said corresponding second edge, wherein said third edge and fourth edge of each of said anode segments include at least one strap ring groove for carrying at least one conductive strap ring, each strap ring groove having a respective groove depth with respect to a corresponding edge of each said plate-shaped anode segment;

wherein said second edge of each of said plurality of plate-shaped anode segments is divided into three portions in a substantially longitudinal direction with respect to said anode cylinder, said three portions of each of said anode segments including a first end portion, a second end portion, and a central portion located between said corresponding first and second end portions, said central portion of each of said anode segments being fully recessed from said corresponding first and second end portions in a direction toward said corresponding first edge, said central portion of each of said anode segments having a length in a substantially longitudinal direction with respect to said anode cylinder; and said length of said central portion of each of said anode segments is considerably less than the difference between the length of the corresponding first edge and the sum of the respective groove depths of said corresponding strap ring grooves on said corresponding third edge and fourth edge.

10. A magnetron apparatus in accordance with claim 9, wherein said length of said central portion of said second edge of each of said plurality of plate-shaped anode segments is 20 to 50% of a length of said corresponding second edge.

11. A magnetron apparatus in accordance with claim 9, wherein a respective chamfered portion is provided on at least one end of said second edge of each of said plurality of plate-shaped anode segments, said respective chamfered portion having a length in a substantially longitudinal direction with respect to said anode cylinder of between 0.2 and 0.6 millimeters.

12. A method for use in manufacturing a magnetron comprising the steps of:

providing a conductive anode cylinder having a substantially cylindrical internal hollow, said anode cylinder including an interior surface defining said substantially cylindrical internal hollow;

providing a plurality of substantially planar, conductive anode segments, each of said plurality of anode segments including a first edge for bonding to said interior surface of said anode cylinder in a substantially longitudinal direction, a second edge opposing said first edge and third and fourth edges, said second edge of each of said anode segments including a first substantially straight portion at one end thereof and a second substantially straight portion at another end thereof, wherein said first and second substantially straight portions are parallel with one another and are each substantially equidistant from said first edge of each said anode segment, said second edge of each of said anode segments also including a recessed portion located between said first and second substantially straight portions in a longitudinal direction, wherein said recessed portion is closer to said corresponding first edge than are said first and second substantially straight portions of each said corresponding second edge; and press-fitting a cylindrical pin onto a central portion of said anode cylinder along a longitudinal axis of said cylinder to apply outward pressure to each of said plurality of anode segments so that said first edge of each of said plurality of anode segments is pressed firmly against said interior surface of said anode cylinder, wherein said cylindrical pin contacts said first and second substantially straight portions of said second edge of each of said plurality of anode segments but does not contact said recessed portion of said second edge of each of said anode segments so that pressure is applied more evenly along a juncture between said first edge of each of said anode segments and said interior surface or said anode cylinder for each of said plurality of anode segments, wherein each said first and second substantially straight portions are substantially equal in length.

13. The method of claim 12, wherein:

said step of press fitting includes the step of inserting said cylindrical pin so that an entire length of said first and second substantially straight portions of each of said anode segments contacts said cylindrical pin after insertion.

14. The method of claim 12, wherein each of said conductive anode segments includes a third edge and fourth edge and said third edge and fourth edge of each anode segment includes a respective strap ring groove; and said length of said central portion of said second edge of each of said anode segments is no greater than a difference between a total length of said corresponding first edge and a sum of the groove depths of said respective strap ring grooves on said corresponding third edge and fourth edge.

15. A manufacturing method for a magnetron apparatus comprising an anode cylinder having a central axis, said method including:

providing a plurality of plate-shaped anode segments, each plate-shaped anode segment having a first edge, second edge, third edge, and fourth edge, the second edge of each of said plate-shaped anode segments being opposite to the corresponding first edge, said second edge of each of said plate-shaped anode segments including first, second, and third portions, said respective second portion being located between said corresponding first and third portions in a direction of said central axis, wherein said first and third portions of said corresponding second edge are substantially parallel to said corresponding first edge and said second portion of said corresponding second edge is recessed with respect to said corresponding first and third portions and wherein said third edge and fourth edge each include a respective strap ring groove; and said length of said second portion of said second edge of each of said plate-shaped anode segments is no greater than a difference between a total length of said corresponding first edge and a sum of the groove depths of said respective strap ring grooves on said corresponding third and fourth edge;

arranging the plurality of plate-shaped anode segments in a radial configuration within said anode cylinder; and press-fitting a cylindrical pin within a void in a central portion of said anode cylinder in a direction of said central axis, said cylindrical pin contacting each of said plurality of plate-shaped anode segments and forcing said plurality of plate-shaped anode segments outward with respect to said central axis so that said first edge of each of said plurality of plate-shaped anode segments presses against the inner surface of said anode cylinder, wherein said cylindrical pin contacts only said first and third portions of said second edge of each of said plate-shaped anode segments resulting in a more uniform pressure being applied to each of said plate-shaped anode segments by said cylindrical pin along said corresponding second edge.

16. A manufacturing method for a magnetron apparatus in accordance with claim 15, further comprising a step in which a chamfered portion is provided on at least one end of said second edge of each of said plate-shaped anode segments, said chamfered portion having a length along a direction of said central axis of between 0.2 and 0.6 millimeters.

17. A manufacturing method for a magnetron apparatus in accordance with claim 15, wherein a length of said second portion of said second edge of each of said plate-shaped anode segments along a direction of said central axis is 20 to 50% of a length of said second edge along said direction of said central axis.

* * * * *